US007117699B2

(12) United States Patent
Bistline

(10) Patent No.: US 7,117,699 B2
(45) Date of Patent: Oct. 10, 2006

(54) METHOD AND APPARATUS FOR SECURING A SPORTS BOARD FIN TO A SPORTS BOARD

(76) Inventor: Donald A. Bistline, P.O. Box 2316, Vista, CA (US) 92085

( * ) Notice: Subject to any disclaimer, the term of this patent is extended or adjusted under 35 U.S.C. 154(b) by 0 days.

(21) Appl. No.: 10/677,594

(22) Filed: Oct. 1, 2003

(65) Prior Publication Data

US 2005/0075017 A1 Apr. 7, 2005

(51) Int. Cl.
*E05B 73/00* (2006.01)
*B63B 35/79* (2006.01)

(52) U.S. Cl. ..... 70/58; 70/14; 70/18; 441/74

(58) Field of Classification Search ..... 441/74, 441/79; 70/14, 18, 58
See application file for complete search history.

(56) References Cited

U.S. PATENT DOCUMENTS 2,677,261 A * 5/1954 Jacobi ..... 70/14
4,340,376 A * 7/1982 Williams ..... 441/74
4,680,949 A * 7/1987 Stewart ..... 70/14
5,109,683 A * 5/1992 Cartwright ..... 70/14
5,119,649 A * 6/1992 Spence ..... 70/14
5,832,754 A * 11/1998 McKenzie ..... 70/58
5,934,963 A * 8/1999 Frizzell ..... 441/79
6,688,145 B1 * 2/2004 Tan ..... 70/58
6,691,537 B1 * 2/2004 Tan ..... 70/58
6,763,689 B1 * 7/2004 Thomas ..... 70/14

* cited by examiner

*Primary Examiner*—Ajay Vasudeva
(74) *Attorney, Agent, or Firm*—Thomas Thibault

(57) ABSTRACT

A method and apparatus for preventing a sports board fin from being removed from the sports board. In one embodiment, an apparatus comprises a fin enclosure for covering the fin, thereby preventing access to it. In another embodiment, the apparatus comprises a housing which covers a fin locking fastener which is secured to a channel in the board. In either embodiment, the apparatus may be used in conjunction with a sports board theft-prevention apparatus, which is secured to a vehicle.

11 Claims, 23 Drawing Sheets

METHOD AND APPARATUS FOR SECURING A SPORTS BOARD FIN TO A SPORTS BOARD

BACKGROUND

I. Field of Use

The present invention relates to the field of theft prevention devices. More specifically, the present invention relates to a method and apparatus for securing sports board fins associated with various kinds of sports boards, such as surfboards, wakeboards, and the like, to the sports board.

II. Description of the Related Art

The sport of surfing has gained in popularity in the United States and abroad over the past several years. It is estimated that there are currently 3.5 million people who enjoy surfing in the United States alone. In most cases, surfboards are transported to the ocean on top of a car via roof racks or in the bed of a pickup truck. The typical method of securing surfboards to car top roof racks is by a canvas or rubber straps.

One of the disadvantages of transporting surfboards via motor vehicle is that few vehicles are large enough to transport surfboards inside. Consequently, most people transport surfboards external to their vehicles. There exists removable or permanent roof-top racks for automobiles whereby one or more surfboards can be secured for transport. Individuals owning pickup trucks can simply place their surfboard(s) in the bed of the pickup truck.

One disadvantage of transporting large objects such as surfboards external to a vehicle is that they are highly visible and therefore attract thieves when an owner leaves the surfboard unattended. These large objects are difficult to secure against theft due to their large size and unibody construction. Most roof racks today do not have a way to lock the surfboard securely to the vehicle. In most cases, elastic straps are all that is used to secure the surfboard to the vehicle. These are quickly and easily removed by thieves.

One solution to this problem is disclosed in a pending United States patent application belonging to the inventor of the present patent application, entitled "Method and Apparatus for Securing an Object to a Vehicle". This application describes an adjustable shackle that is secured to a vehicle roof rack, or to the bed of a pickup truck. A sports board is secured to the vehicle by placing the board through the adjustable shackle and then adjusting the shackle to fit snugly against the sides of the board. The board is prevented from being removed from the adjustable shackle by the contour of the board and by fins, bindings, or other physical constraint, typically attached to the board.

The patent application described above also describes a fin guard used in conjunction with the adjustable shackle. The fin guard is designed to prevent removal of a surfboard fin by covering hardware used to attach the fin and wedging between a surface of the board and an inside portion of the adjustable shackle.

One of the features of the fin guard described in the patent application described above is that the fin guard is most effective when the fin is in close proximity to the adjustable shackle. However, as the length of a surfboard increases, this fin guard becomes less effective because the fins are located further and further away from the adjustable shackle when the sports board is secured in place. In turn, the fin guard of the patent application described above may not be long enough to cover the fin mounting hardware and also to wedge between the board and the adjustable shackle.

Another problem with the fin guard described in the patent application described above is that it may not be able to prevent fin removal of some newer fin designs that have been recently introduced into the marketplace. The newer fin removal systems allow a fin to be removed from a surfboard without any type of locking hardware. These fins can be removed simply by prying them out of the "fin box", rather than being secured by locking hardware.

What is needed, therefore, is an apparatus to prevent a surfboard fin from being removed from a surfboard, no mater what the board length, and no matter what type of fin mounting arrangement is used. Ideally, the apparatus could be used in conjunction with the adjustable locking mechanism described in the patent application described above.

SUMMARY

A method and apparatus for securing a sports board fin to a sports board. In one embodiment, an apparatus comprises a fin enclosure for covering a fin and an elongated member, connected to the fin enclosure, sized and shaped to wedge between a surface of the board and a sports board security apparatus.

In another embodiment, an apparatus for securing a sports board fin to a sports board comprises a housing sized and shaped to cover a fin mounting fastener, a shaft extending perpendicularly from the housing, sized and shaped to extend within a channel located underneath a bottom surface of the sports board, a tab located at a first end of the shaft, the tab sized and shaped to engage a lip of the channel when the housing is rotating to a first position, and for disengaging the tab from the lip when the housing is rotated to a second position, an extendable deadbolt sized and shaped to extend into the channel and located at an axis perpendicular to a longitudinal axis of the tab, and a locking mechanism, for locking the deadbolt into the channel when the locking mechanism is in a locked position, and for allowing the deadbolt to retract out of the channel when the locking mechanism is in an unlocked position.

In another embodiment, an apparatus for securing a sports board fin to a sports board comprises a mounting bracket, a mating unit removably connected to the mounting bracket, the mating unit comprising an adjustable shackle, a mating portion fixedly secured to the adjustable shackle, and a first locking mechanism operative to allow adjustment of the shackle in an unlocked position and to prevent adjustment of the shackle in a locked position. The apparatus further comprises means for removably securing the mating portion to the mounting bracket, and a fin guard for preventing a fin located on the sports board from being removed.

In another embodiment, an apparatus for securing a sports board fin to a sports board comprises a housing sized and shaped to cover a fin mounting fastener, a shaft extending perpendicularly from the housing, sized and shaped to extend within a channel located underneath a bottom surface of the sports board, a tab located at a first end of the shaft, the tab sized and shaped to engage a lip of the channel when the housing is rotated to a first position, and for disengaging the tab from the lip when the housing is rotated to a second position, an extendable deadbolt located at an axis perpendicular to a longitudinal axis of the tab, and a second locking mechanism for locking the deadbolt into the channel when the locking mechanism is in a locked position, and for allowing the deadbolt to retract out of the channel when the locking mechanism is in an unlocked position.

In yet another embodiment, a method for securing a sports board fin to a sports board comprises installing a sports board security apparatus to a vehicle, securing the sports board to the sports board security apparatus, and securing at least one fin located on the sports board with a fin guard, the fin guard for preventing the at least one fin from being removed from the sports board.

In yet still another embodiment, an apparatus for securing a sports board fin to a sports board comprises means for covering the sports board fin, and means for securing the means for covering the sports board fin to the sports board.

In yet still another embodiment, an apparatus for securing a sports board fin to a sports board comprises means for covering a fin mounting fastener, means, extending from the means for covering the fin mounting fastener, for engaging a lip of a channel located underneath a bottom surface of the sports board while the covering means is in a first position, and means for disengaging the engaging means from the lip when the covering means is in a second position.

Finally, in another embodiment, an apparatus for securing a sports board fin to a sports board comprises means for securing the sports board to a vehicle, and means for preventing removal of a fin located on the sports board.

BRIEF DESCRIPTION OF THE DRAWINGS

The features, advantages, and objects of the present invention will become more apparent from the detailed description as set forth below, when taken in conjunction with the drawings in which like referenced characters identify correspondingly throughout, and wherein.

DETAILED DESCRIPTION

The methods and apparatus for securing a sports board fin to a sports board detailed herein enable one to quickly and easily secure a sports board fin to a sports board, such as a surfboard for use in securing the sports board to a vehicle to prevent theft. However, it should be understood that other types of articles could be secured in the alternative, such as snow skis, water skis, wakeboards, snowboards, etc.

Figure 1:
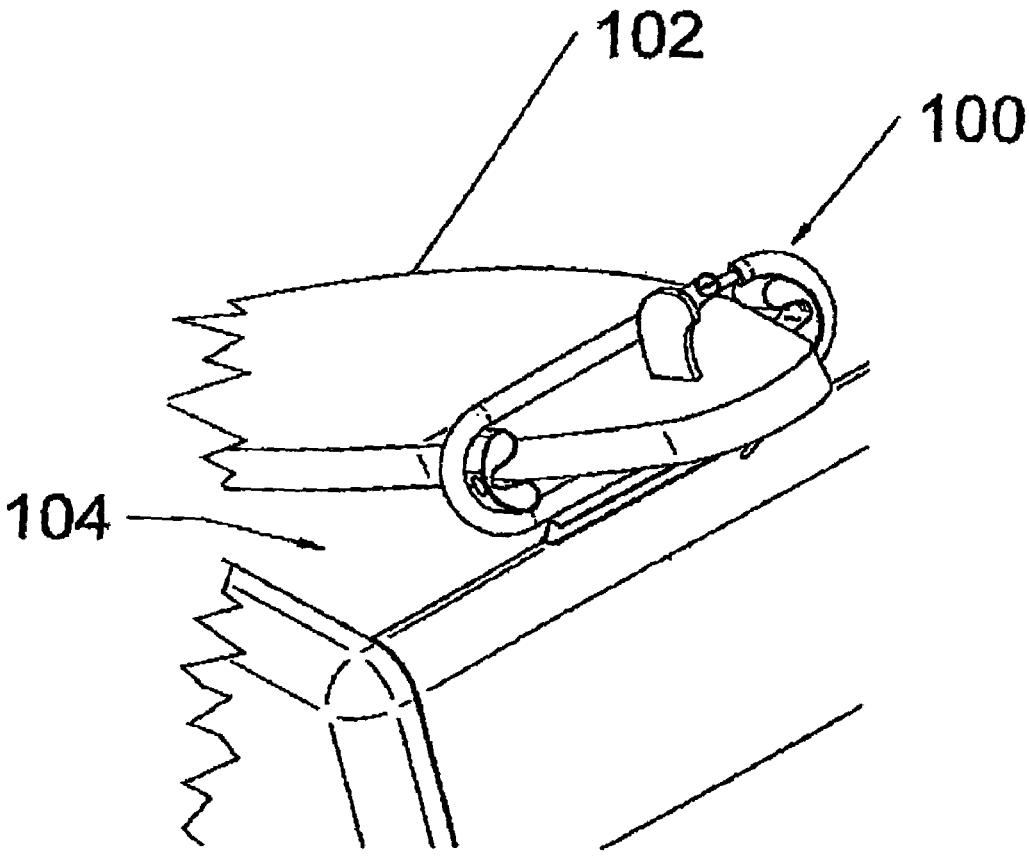
FIG. 1 illustrates one embodiment of a security apparatus for securing a sports board to a vehicle.

FIG. 1 illustrates one embodiment of a security apparatus 100 for securing a sports board to a vehicle. Shown is a surfboard 102 lying upside-down in the bed 104 of a typical pick-up truck. The rear portion of the surfboard extends past the tailgate of the pick-up truck with its tip lying on the floor of bed 104. The security apparatus 100 comprises a mounting bracket and mating unit, discussed later herein. The mating unit comprises an adjustable, locking shackle which is designed to fit snugly around the width of the surfboard 102 while in a locked position. The physical properties of the surfboard 102 (i.e., board contour, fin(s)) prevent it from being removed from the adjustable shackle. Other objects are retained within the adjustable shackle by their physical properties, such as board shape, bindings, etc. The mating unit is designed to be easily removed from the mounting bracket when security apparatus 100 is not in use, so that it does not interfere with other uses of the pick-up truck during normal use.

Figure 2A:
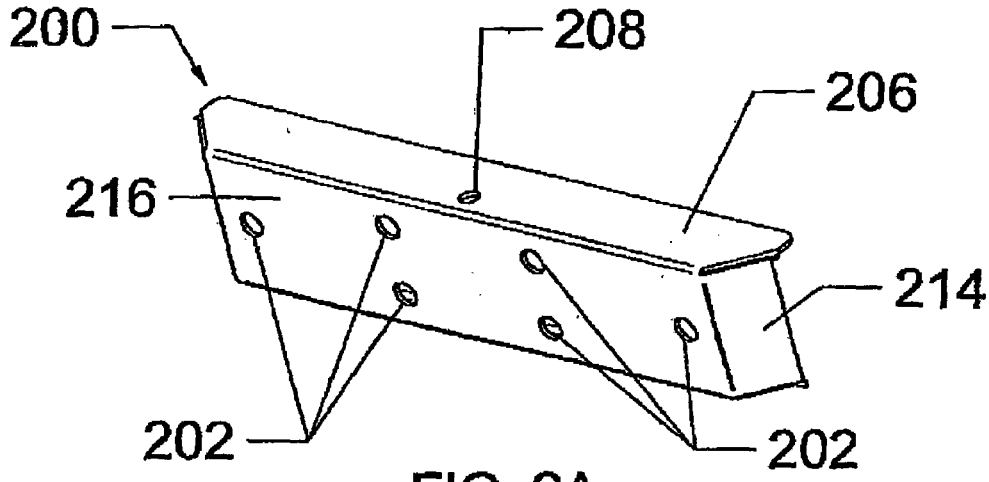
FIGS. 2*a* and 2*b* illustrate one embodiment of a mounting bracket of the security apparatus in FIG. 1.
Figure 2B:
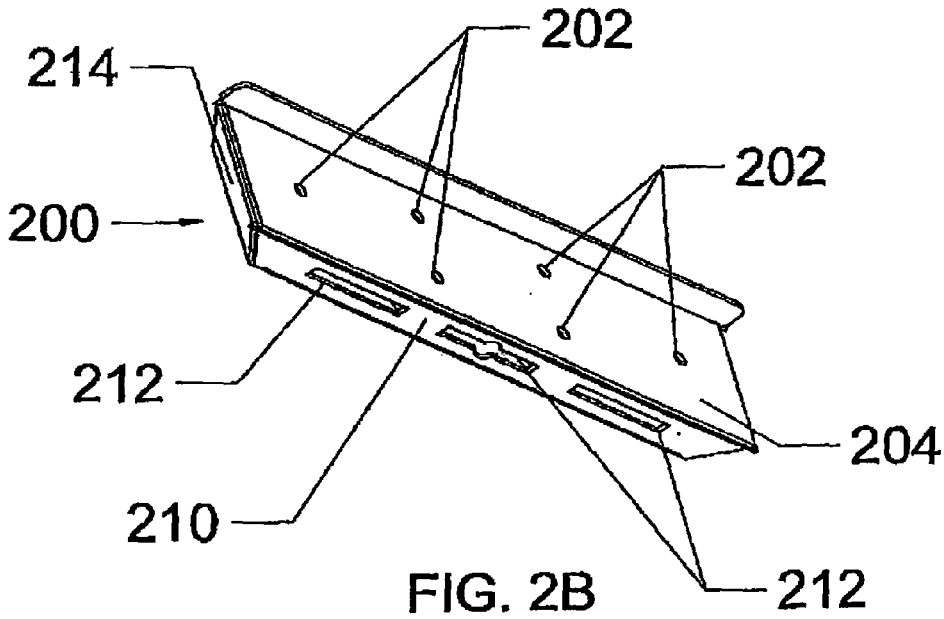

FIGS. 2*a* and 2*b* illustrate one embodiment of a mounting bracket 200, shown in two isometric views. The mounting bracket 200 is designed to be fixedly installed onto a vehicle, such as against an inside portion of a tailgate of a pickup truck. Of course, mounting bracket 200 could alternatively be located in other locations on a vehicle, such as the roof of any vehicle, or on any location in a bed 104 of a pickup truck, such as the outer portion of a tailgate, or on an inside or outside portion of bed 104. As used herein, the term "fixedly" generally means that mounting bracket 200 is not easily be removed.

Mounting bracket 200 is typically manufactured out of any durable, rigid material, such as any type of metal, wood, plastic, or other suitable material. It may comprise a hollow "box", having a top surface 206, a bottom surface 210, side surfaces 214, and a rear planar surface 204. It may also include a front surface 216 for forming a hollow enclosure. A great number of alternative embodiments are possible, including mounting bracket 200 comprising only top surface 206, bottom surface 210, and rear planar surface 204. In another alterative embodiment, mounting bracket 200 comprises a solid block of material. In yet another alternative embodiment, mounting bracket 200 comprises only rear planar surface 204 and top surface 206. Mounting bracket 200 is also not restricted to a rectangular shape. As such, mounting bracket 200 may comprise a square, rectangle, triangle, circle, or other shape when viewed in a planar manner.

In the example of FIG. 1, mounting bracket 200 is fixedly attached to an inside portion of a pickup truck tailgate using one or more fastening devices, such as screws, bolts, rivets, or other known fastening devices, through mounting holes 202 located on a rear planar surface 204 and/or on front surface 216. Of course, mounting bracket 200 could be fixedly attached to a surface by using mounting brackets, or even by welding. The only limitation regarding the way in which mounting bracket 200 is fixedly attached to a surface is that it is not easily removable after installation.

In one embodiment, mounting bracket 200 comprises a top surface 206, having an aperture 208 located thereon, and a bottom surface 210, having, in this embodiment, three slots 212. Aperture 208 is designed to receive a rigid element, such as a pin, bolt, shackle, or other element which removably secures a mating unit, described later herein, to mounting bracket 200. The slots 212 are each designed to receive a tab from the mating unit. The combination of these two features allow the mating unit to be removably secured to mounting bracket 200. The term "revovably", as used herein, generally means that the mating unit is able to be quickly and easily installed and removed from mounting bracket 200.

Figure 3:
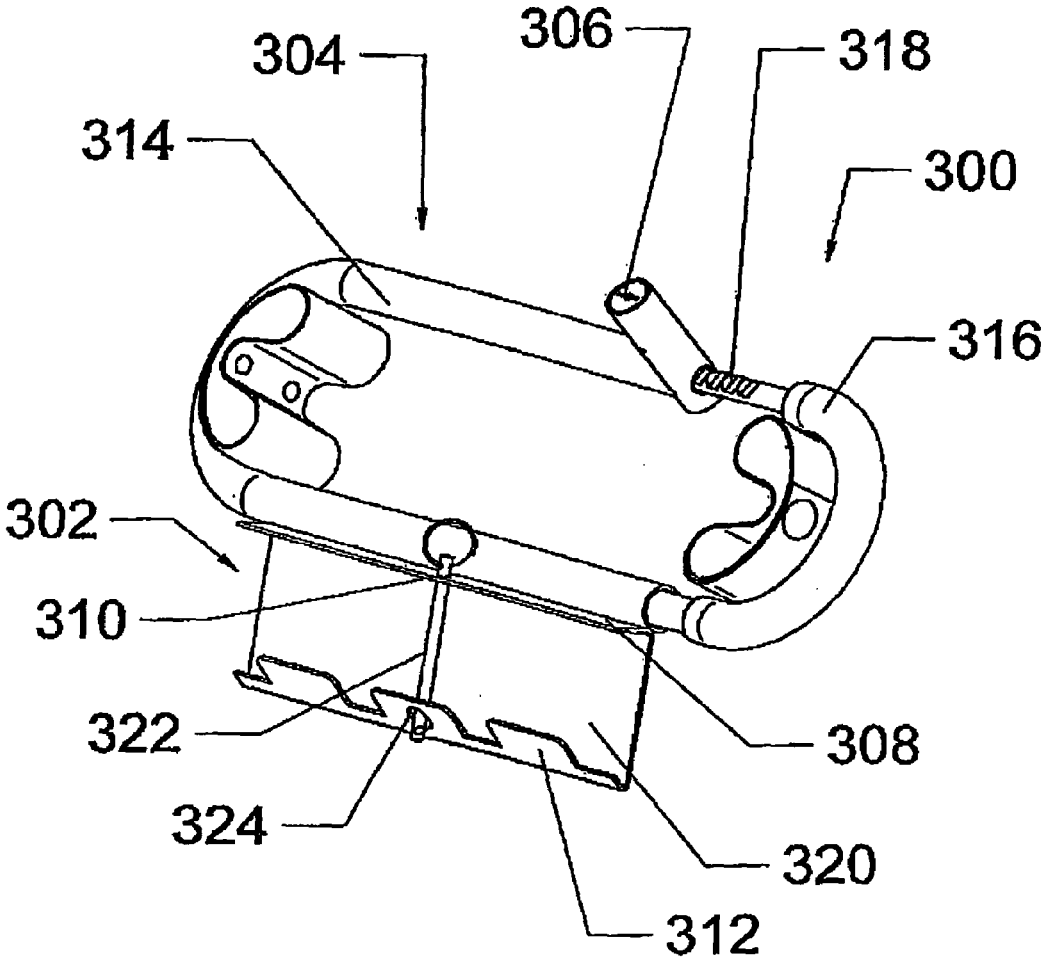
FIG. 3 illustrates one embodiment of a mating unit, suitable for use with the security apparatus of FIG. 1.

FIG. 3 illustrates one embodiment of a mating unit 300 and a retaining pin 322 of the security apparatus of FIG. 1. In this embodiment, mating unit 300 comprises a mating portion 302, an adjustable shackle 304, and a locking mechanism 306. Mating unit 300 is also preferably constructed of a rigid material such as metal, wood, plastic, rubber, or a combination of materials, strong enough to prevent a thief from destroying mating unit 300 during an attempted theft. A fixed portion 314 of adjustable shackle 304 is fixedly connected to a top surface 308 of mating portion 302, typically by welding or other suitable method known in the art. An adjustable portion 316 of adjustable shackle 304 inserts into fixed portion 314, thereby forming an adjustable opening through which surfboard 102, or other object, may be placed.

Both adjustable portion 316 and fixed portion 314 are preferably formed of a material not easily cut through with a hacksaw, for instance. The outer surface of each portion may additionally be covered with a hard plastic, rubber, or other material to add difficulty to anyone attempting to cut through either portion. Alternatively, or in addition to the hard material, padding may be deposited on fixed portion 314 and a portion of adjustable portion 316 so that minimal damage that might otherwise occur to an object that is secured by adjustable shackle 304.

Locking mechanism 306 comprises a combination or key-operated lock, similar to many adjustable locking devices in common use today. Examples of manufacturers offering such a locking mechanism include ABA locks and Royal Lock Corporation of Wauconda, Ill. Locking mechanism 306 typically comprises a spring-loaded deadbolt which engages a series of notches 318 located on adjustable portion 316. In an unlocked position, the deadbolt is pushed into a shank portion of locking mechanism 306 as each of notches 318 pass the deadbolt, thereby allowing free movement of adjustable portion 316 within fixed portion 314 and, thus, allowing an opening formed by adjustable shackle 304 to vary. In a locked position, the deadbolt is prevented from being pushed out of notches 318, thereby preventing the opening formed by adjustable shackle 304 from varying.

Mating portion 302 comprises a top surface 308, having an aperture 310 located thereon, a lower portion 312, and a plate 320 connecting top surface 308 and lower portion 312. Aperture 310 aligns with aperture 208 during assembly of mounting bracket 200 and mating unit 300, whereby retaining pin 322 is inserted through the apertures, removably securing mating unit 300 to mounting bracket 200. Retaining pin 322 comprises a pin, dowel, plug, shackle, wedge, or the like, that, when inserted through apertures 208 and 310 (and in combination with lower portion 312 and slots 212), prevents mating unit 300 from being removed from mounting bracket 200 and, hence, the vehicle. As just mentioned, in one embodiment, lower portion 312 comprises three "tabs" for insertion through slots 212 of mounting bracket 200. In other embodiments, there may be fewer or a greater number of tabs, the tabs could comprise pins, or any other extrusion, to fit within a corresponding slot, or other opening, on lower surface 210. In the embodiment of FIG. 3, the center tab comprises an aperture 324 which aligns with aperture 208 and receives retaining pin 322 during assembly of mounting bracket 200 and mating unit 300. In yet another embodiment, lower portion 312 could comprise a rectangular flange having no tabs, pins, or other extrusions, but comprises an aperture which aligns with an aperture located on lower surface 210 during assembly of mounting bracket 200 and mating unit 300. Retaining pin 322, having sufficient length, could then be inserted through both sets of apertures (i.e., aperture 208 and aperture 310, and the apertures located on lower portion 312 and lower surface 210), securing the two units together.

A key feature of the embodiments presented herein is that mating unit 300 is removably secured to mounting bracket 200 without the use of a locking mechanism. This allows quick installation and removal of the mating unit. In addition, a second key or combination is not needed (in addition to a key or combination for use with locking mechanism 306) to secure mating unit 300 to mounting bracket 200. The retaining pin 322 is prevented from being removed when a surfboard or similar object is secured through adjustable shackle 304 because the surfboard surface lays on top of retaining pin 322.

Figure 4:
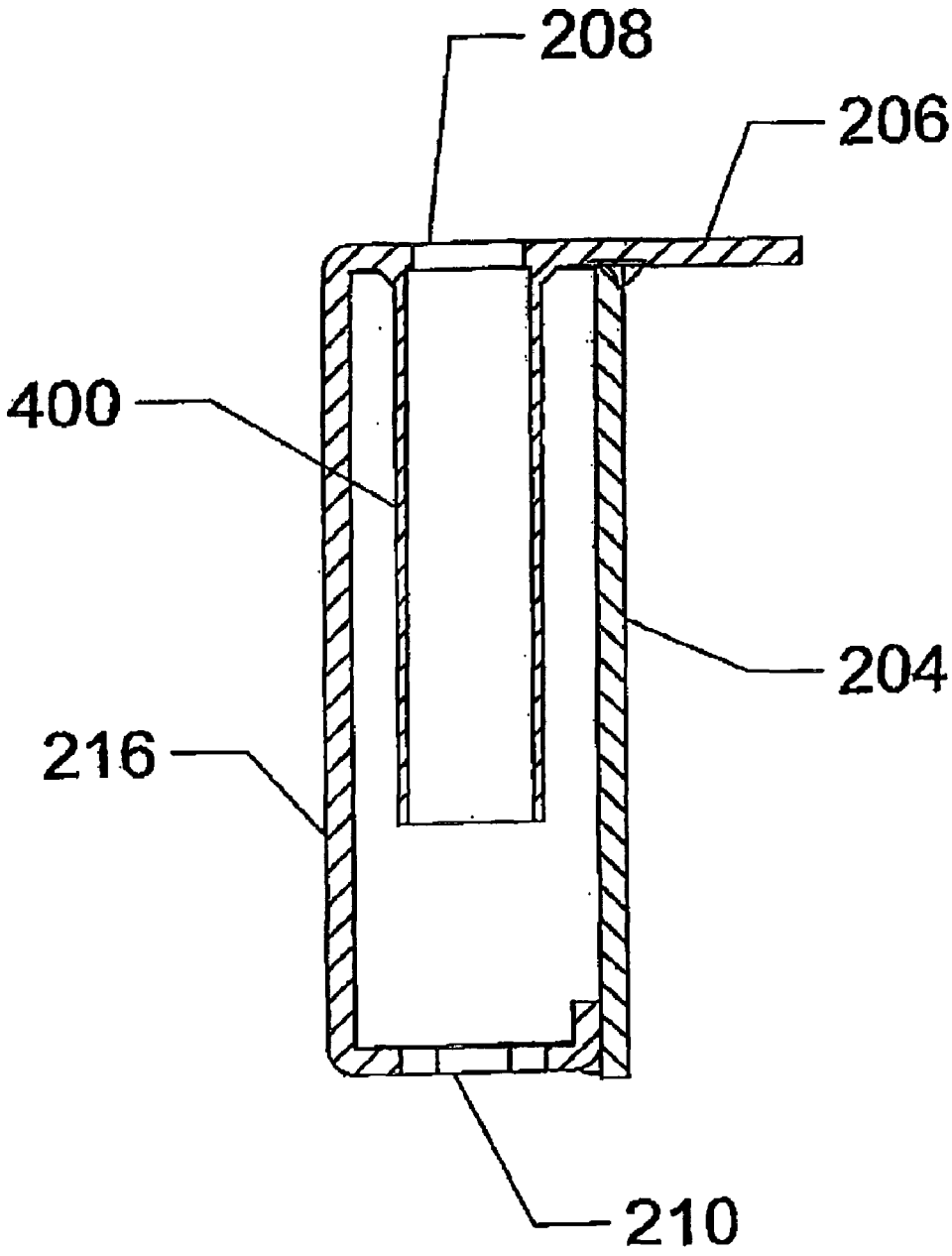
FIG. 4 illustrates an optional cylinder for use with the mounting bracket of FIG. 2 shown in a close-up, cross-sectional view.

FIG. 4 illustrates an optional cylinder 400 for use with the mounting bracket of FIG. 2, shown in a close-up, cross-sectional view. The cylinder 400 prevents retaining pin 322 from being moved laterally from an alignment with aperture 208. This prevents a potential thief from attempting to remove retaining pin 322 by wiggling the pin and removing it in spite of surfboard 102 covering the pin. The cylinder 400 is typically welded to an undersurface of top surface 206 having a diameter sufficiently large enough to allow retaining pin 322 to be inserted therein.

Figure 5:
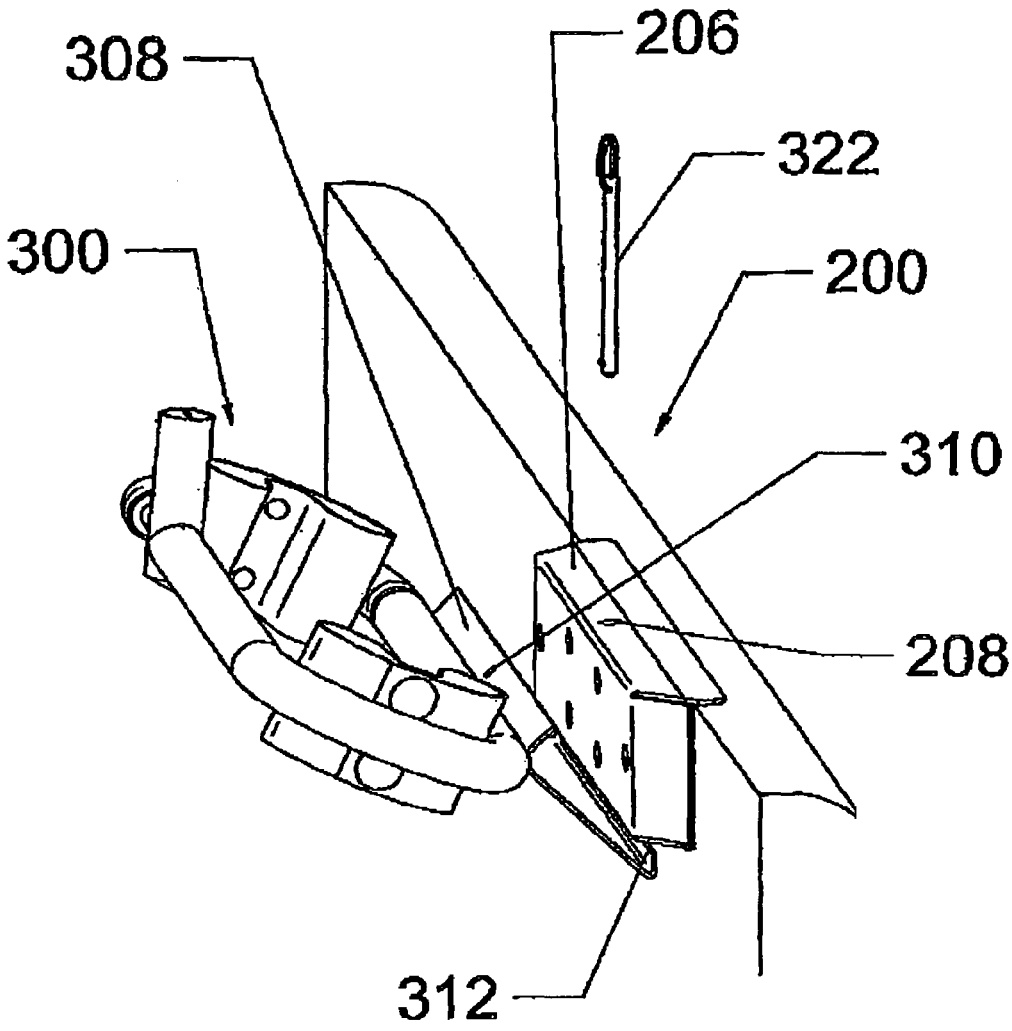
FIG. 5 illustrates the mating unit of FIG. 3 being removably installed onto the mounting bracket of FIG. 2, installed on an inside surface of a pickup truck tailgate.

FIG. 5 illustrates the mating unit 300 of FIG. 3 being removably installed onto the mounting bracket 200 of FIG. 2, installed on an inside surface of a pickup truck tailgate, shown from a side view. Mounting bracket 200 is fixedly secured to the tailgate using the methods described above. Lower portion 312, comprising three tabs in this example, is inserted into slots 212, then mating unit 300 is pivoted so that top surface 308 of mating unit 300 covers top surface 206 of mounting bracket 200. Retaining pin 322 is then inserted through aperture 310 of mating unit 300, aperture 208 of mounting bracket 200, and optionally, an aperture located on lower portion 312 of mating unit 300. This design allows for fast installation and uninstallation of the mating unit 300, which is a major advantage over other security mechanisms.

Figure 6:
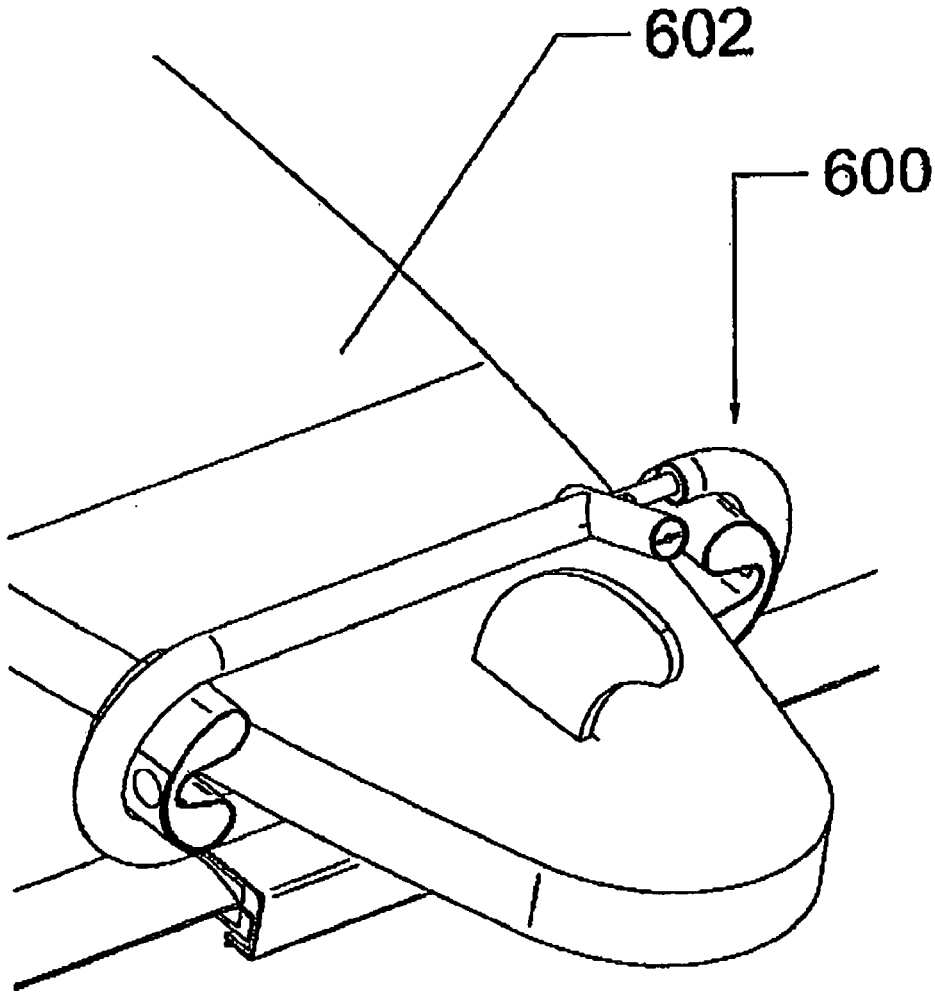
FIG. 6 illustrates another embodiment of a security apparatus for securing an object to a vehicle.

FIG. 6 illustrates another embodiment of a security apparatus 600 for securing an object to a vehicle. Shown is surfboard 602 secured to a vehicle roof rack 604. The security apparatus 600 comprises a set of mounting brackets fixedly secured to roof rack 604 and a mating unit, discussed later herein. Similar to security apparatus 100 of FIG. 1, the mating unit comprises an adjustable, locking shackle, and is designed to be easily removed from the mounting brackets when security apparatus 600 is not in use. Objects such as surfboards, skis, wakeboards, and snowboards are retained within the adjustable shackle by their respective physical properties such as board contour, fin(s), bindings, etc.

Figure 7:
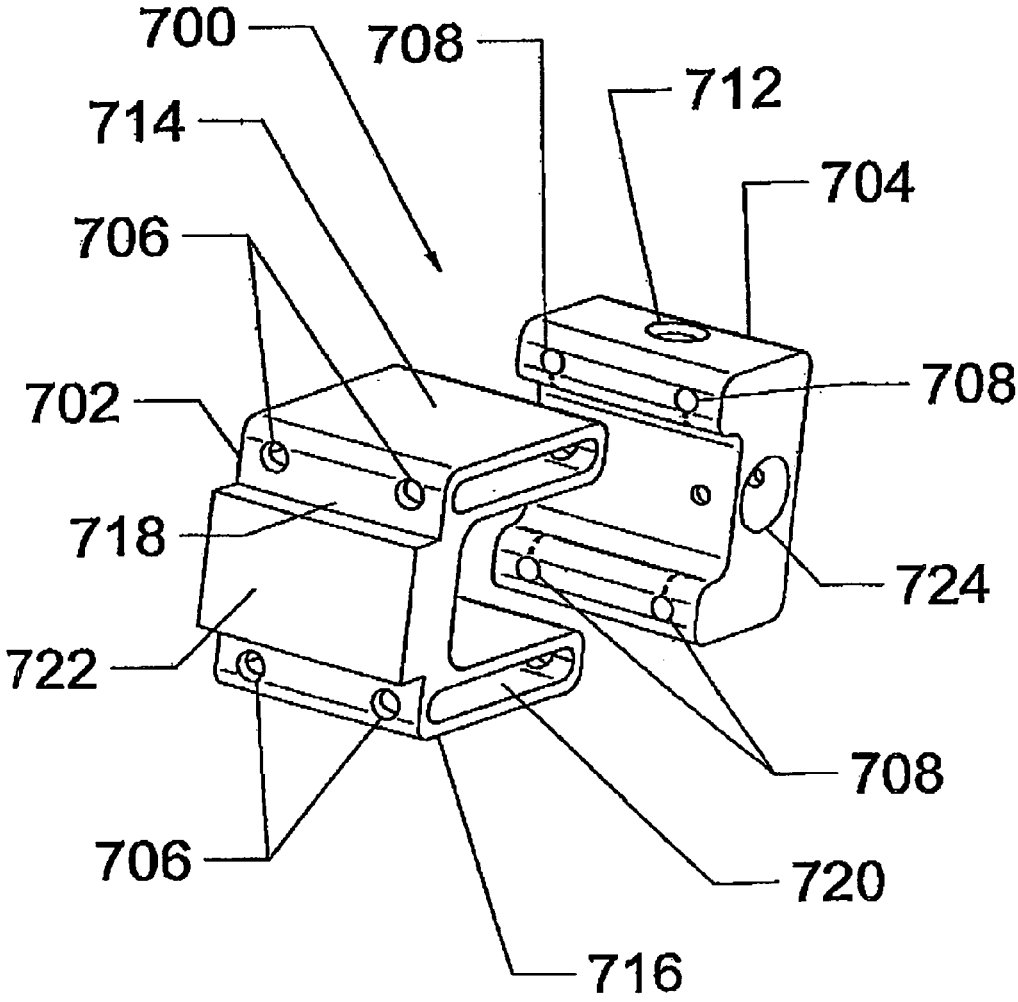
FIG. 7 illustrates a mounting bracket suitable for use with the security apparatus of FIG. 6.

FIG. 7 illustrates a mounting bracket suitable for use with the security apparatus of FIG. 6, shown as mounting bracket 700. Mounting bracket 700 is designed to be fixedly installed onto a vehicle roof rack, and comprises U-shaped bracket 702 and receiving block 704. U-shaped bracket 702 and receiving block 704 are fixedly secured to a vehicle roof rack by placing these elements around such a rack, through an opening formed by the joinder of bracket 702 and block 704. They are secured around the roof rack using fastening means (not shown) such as screws, rivets, bolts, or any other suitable means known in the art, through holes 706 and receptacles 708. Of course, these elements may be secured by other means, such as by welding.

U-shaped bracket 702 comprises a top portion 714, a bottom portion 716, both joined by a rear portion 718. In this embodiment, top portion 714 and bottom portion 716 each comprise a channel 720 running the entire width of each portion, and rear portion 718 comprises a riser 722. These features are optional in the design of mounting bracket 700. The riser 722 is used as a surface against which a mating unit (described below) rests upon assembly.

U-shaped bracket 702 additionally comprises four through holes 706. These holes allow mating hardware, such as screws, rivets, bolts, etc. to be inserted therethrough to engage receptacles 708, such as threaded holes or inserts, in receiving block 704.

Receiving block 704 comprises aperture 712, which is a hole that extends at least a portion through the height of receiving block 704. Aperture 712 is designed to align with two apertures located on a mating unit as the mating unit is installed onto each mounting bracket 700.

Typically, two mounting brackets 700 are used on a single roof rack for securing an object, while a second roof rack may comprise ordinary means for securing the object during transport. The two mounting brackets 700 are generally spaced apart from one another, approximately twelve inches in one embodiment. In one embodiment, receiving block 704 comprises an alignment hole 724 located on one side of receiving block 704. The alignment hole 724 is designed to receive an alignment rod (not shown) for insertion therein and to a similar hole located on a side of another mounting bracket 700. The alignment rod allows the two mounting brackets 700 to maintain a fixed relationship with each other, which may be important, depending on the shape and curvature of the roof rack to which they are secured.

It should be understood that mounting bracket 700 could comprise numerous alternative features and should not be limited to only the embodiment shown in FIG. 7. In one alternative embodiment, the bracket 702 and block 704 are formed of two sections that surround a roof rack from the bottom and the top, rather than surrounding the roof rack from the sides, as shown in FIG. 7. In other examples, fewer or a greater number of through holes 706 could be used, the through holes 706 could be threaded, aperture 712 could be located through top portion 714, bottom portion 716, and rear portion 718 either alternatively, or in addition to the aperture 712 located on receiving block 704, the alignment hole 724 could be of any cross-sectional shape, including a rectangle, triangle, ellipse, etc.

As mentioned previously, mounting bracket 700 is installed around a roof rack, typically mounted to a roof of a vehicle. However, most roof racks in use do not have a cross section conforming to the opening formed by the joinder of bracket 702 and block 704. Typically, a roof rack cross-section comprises a "wing" cross-section, being flat on a bottom surface and rounded on a top surface. In this case, mounting bracket 700 may not fit well over the roof rack, and allow the mounting bracket 700 to pitch to and fro or allow the mounting bracket 700 to slide out of position on the roof rack. To alleviate this problem, a pair of inserts may be positioned inside the opening of mounting bracket 700, having an outer surface that conforms to the surface of the mounting bracket opening, and an inner surface that conforms to the roof rack surface. Details of this type of insert can be found on FIGS. 13*a* and 13*b*, along with accompanying text.

Figure 8:
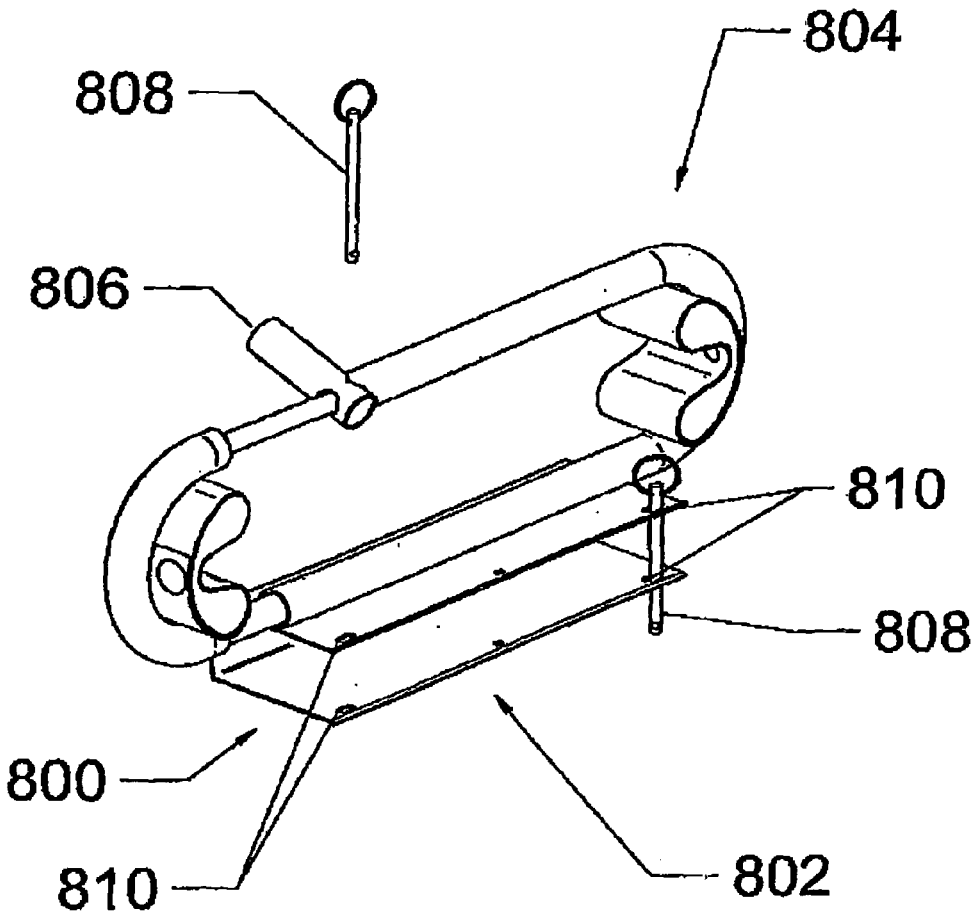
FIG. 8 illustrates a mating unit suitable for use with the security apparatus of FIG. 6.

FIG. 8 illustrates a mating unit 800 suitable for use with the security apparatus of FIG. 6 and retaining pins 808. Mating unit 800 comprises a mating portion 802, an adjustable shackle 804, and a locking mechanism 806. The structures of mating unit 800 are much the same as mating unit 300, with the exception of mating portion 802. In this embodiment, mating portion 802 comprises an "U" shaped extrusion, having adjustable shackle affixed thereto. The extrusion is designed to slide over a pair of mounting brackets 700 fixedly secured to a vehicle roof rack. The extrusion is removably secured to the mounting brackets by inserting two retaining pins 808 through apertures 810 located on each end of mating portion 802 and through aperture 712 located on each of the mounting brackets. Once an object such as a surfboard is secured in place by adjustable shackle 804, the retaining pins 808 are not easily removed, because the surface of the object interferes with removal of the retaining pins 808.

Figure 9:
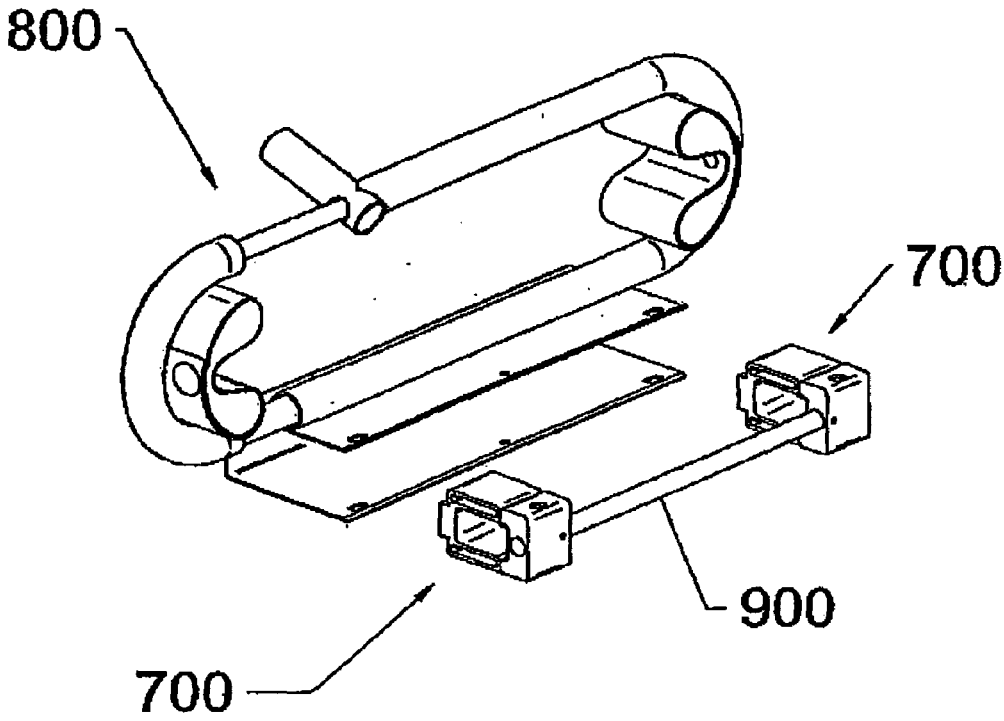
FIG. 9 illustrates the mating unit of FIG. 8 about to be removably installed onto two mounting brackets shown in FIG. 7, installed on a vehicle roof rack.

FIG. 9 illustrates the mating unit 800 of FIG. 8 about to be removably installed onto two mounting brackets 700 of FIG. 7, installed on a vehicle roof rack. Shown is optional alignment rod 900 connecting the two mating units.

Figure 10:
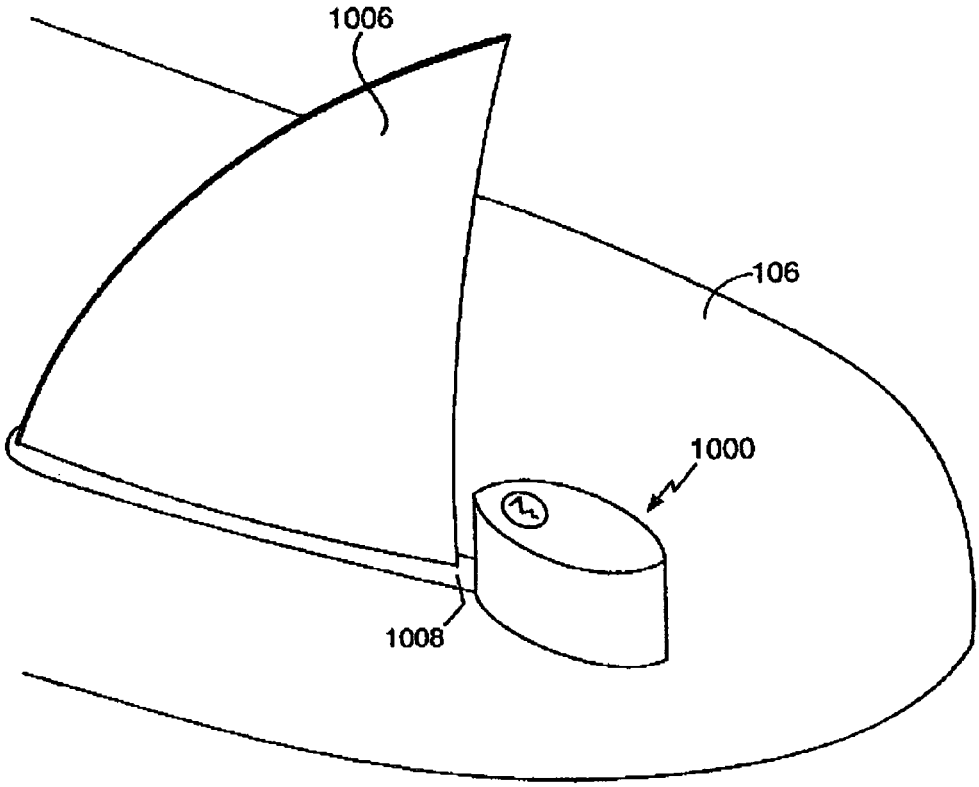
FIG. 10*a* is a top-view illustration of one embodiment of a fin guard showing how the fin guard covers a fin mounting fastener via a circular channel formed on the bottom of the fin guard.
Figure 10A:
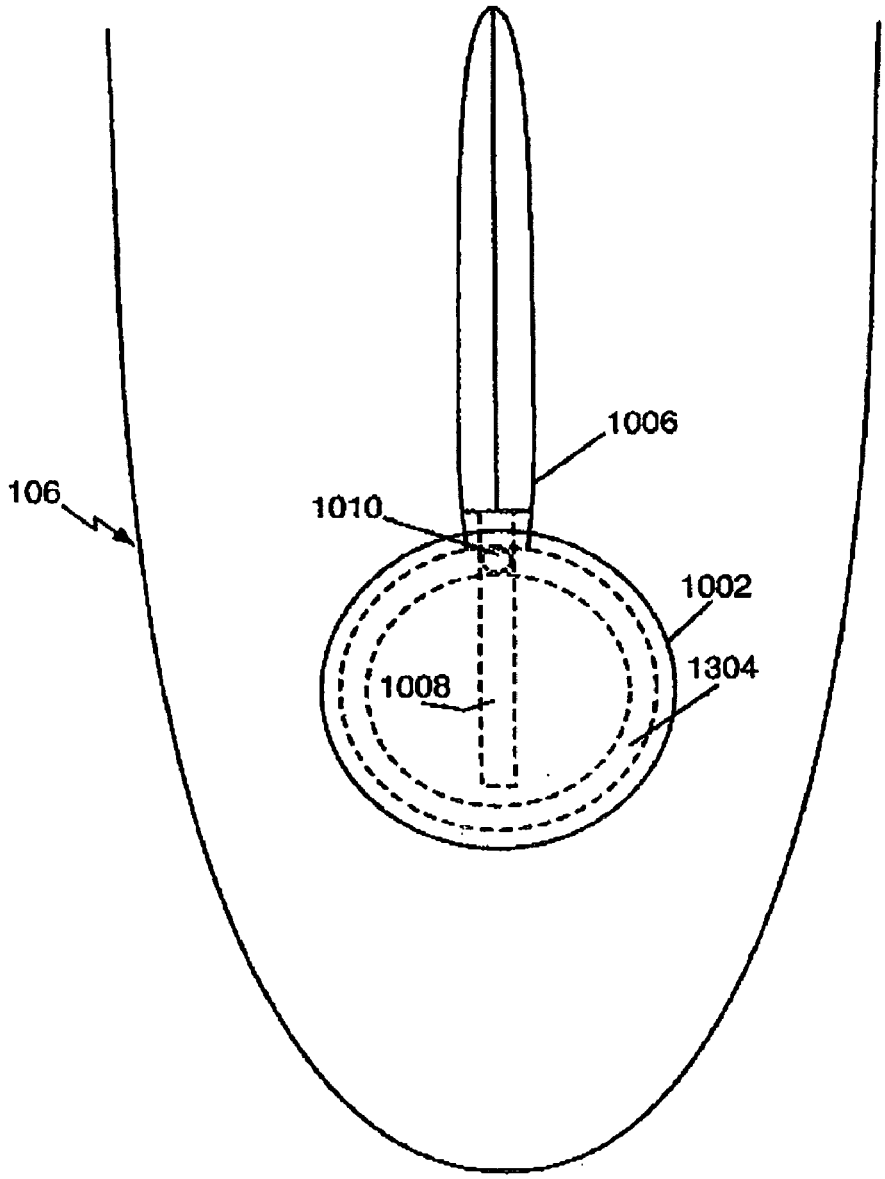

FIG. 10 illustrates fin, guard 1000 generally for use with the security apparatus of FIG. 1 or FIG. 6, shown installed onto a surfboard. FIG. 10*a* is a top-view illustration of one embodiment of fin guard 1000 showing how the fin guard 1000 covers a fin mounting fastener 1010 via a race 1304 formed on the bottom surface of fin guard 1000. Some features of fin guard 1000 have been omitted for clarity. Fin guard 1000 may be used in situations where the fins of a surfboard are removable. Such removable fins have become popular in recent years, because they allow for easier transportation and storage of surf boards, and allow inexpensive replacement if a fin should become damaged. However, removing one or more fins from a surfboard 602 secured by security apparatus 100 or 600 might allow a thief to slide the surfboard out from the adjustable shackle. Fins using this type of design are generally removable by accessing fin mounting fastener 1010 generally installed directly behind fin 1006 and into a channel 1008 located underneath a bottom surface of the surfboard.

In one embodiment, fin guard 1000 comprises a housing 1002 and a locking mechanism 1004. Fin guard 1000 mounts to the surface of surfboard 106 over channel 1008 generally behind fin 1006 and covers a fin mounting fastener, such as a screw, bolt, rivet, clip, or other fastening device, generally located within channel 1008. Housing 1002 thus prevents access to the fin mounting fastener, thereby preventing removal of the fin. Fin guard 1000 is held in place over channel 1008 by a combination of a shaft/tab arrangement and a retractable deadbolt (not shown), both described in detail below. Fin guard 1000 is typically constructed of a rigid material such metal or other material difficult for a thief to destroy. It should be understood that fin guard 1000 may comprise virtually any shape when viewed from a top view, including square, rectangular, oval, or triangular shapes, among others.

Figure 11:
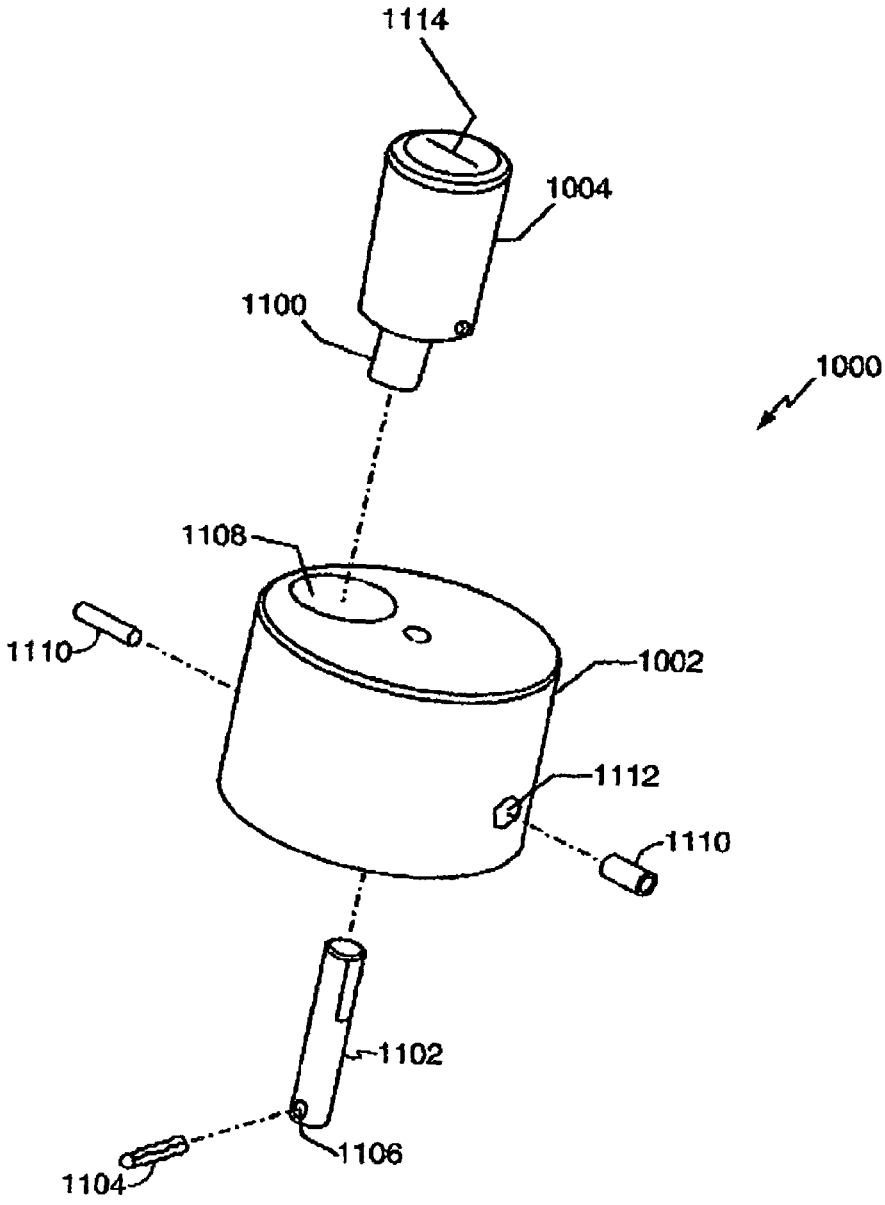
FIG. 11 is an exploded view of the fin guard of FIG. 10.

FIG. 11 illustrates the fin guard 1000 of FIG. 10 in an exploded view. Shown are housing 1002, locking mechanism 1004, retractable deadbolt 1100, shaft 1102, tab 1104, tab mounting hole 1106, locking mechanism mounting hole 1108, locking mechanism retaining hardware 1110, retaining hardware hole 1112, and keyed portion 1114.

Locking mechanism 1004 and retractable deadbolt 1100 are generally purchased as a single unit. Locking mechanism 1004 is fixedly installed into locking mechanism hole 1008, secured by, for example, retaining hardware 1110, which may comprise any known fastening devices, such as a nut and bolt combination, a pin and receptacle combination, etc.

In an unlocked position, a keyed portion 1114 of locking mechanism 1004 is raised a certain distance above a top surface of housing 1002, while the retractable deadbolt 1100 is retracted within housing 1002. In a locked position, keyed portion 1114 is pushed down into housing 1002, forcing deadbolt 1100 to extend from a bottom surface of housing 1002. A key is then used to lock deadbolt 1100 into the extended position. Generally, keyed portion 1114 remains within housing 1002 in the locked position and is spring-loaded such that it extends into the raised position upon being unlocked. It should be understood that although locking mechanism 1004 is shown as a keyed locking mechanism, other types of locking mechanisms could be used in the alternative, such as a combination locking mechanism.

Shaft 1102 is, in one embodiment, fixedly attached to a bottom surface of housing 1002. A pin or tab 1104 is inserted through a tab mounting hole 1106 in one end of shaft 1102. In one embodiment, tab 1104 is inserted such that only one end of tab 1104 protrudes from tab mounting hole 1106, while in another embodiment, tab 1104 is inserted such that two ends protrude from tab mounting hole 1106. Thus, tab 1104 is in a fixed relationship with shaft 1102 and, therefore, housing 1002. Therefore, if housing 1002 is rotated around a longitudinal axis, tab 1104 will likewise rotate in relation to housing 1002.

Figure 12:
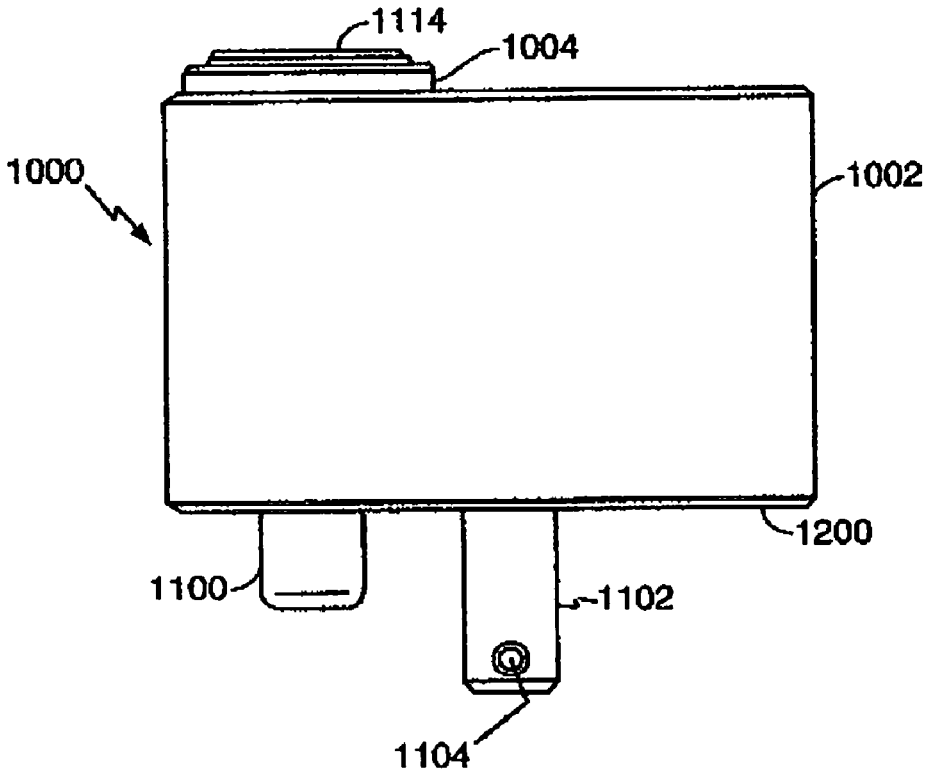
FIG. 12 is a side view of the fin guard of FIG. 10.

FIG. 12 illustrates fin guard 1000, shown in a side view, having housing 1002, locking mechanism 1004, shaft 1102, tab 1104, deadbolt 1100, and lower surface 1200. Deadbolt 1100 is shown in an extended position, with locking mechanism 1004 in a locked position. When locking mechanism 1004 is in an unlocked position, deadbolt 1100 retracts into housing 1002. It should be understood that although this embodiment of fin guard 1000 comprises deadbolt 1100 being retractable and shaft 1102/tab 1004 being fixed with respect to housing 1002, fin guard 1000 could alternatively comprise a shaft/tab combination that is rotatable with respect to housing 1002 by using locking mechanism 1004, while deadbolt 1100 is fixed in an extended position as shown in FIG. 12. In this embodiment, housing 1002 is placed over channel 1008 with tab 1004 oriented parallel to channel 1008 and deadbolt 1100 aligned with channel 1008, allowing both deadbolt 1100 and tab 1004 to be inserted within channel 1008, bringing housing 1002 flush against channel 1008. Then, locking mechanism is placed in a locked position, whereby shaft 1102 and tab 1004 are rotated such that tab 1004 becomes perpendicular to channel 1008, lodging tab 1004 underneath a lip of channel 1008 (illustrated as lip 1400 in FIG. 14*a*). In this position, housing 1002 is prevented from being removed from channel 1008 by tab 1004 engaged with the lip of channel 1008, while housing 1002 is prevented from being rotated by deadbolt 1100.

Figure 13:
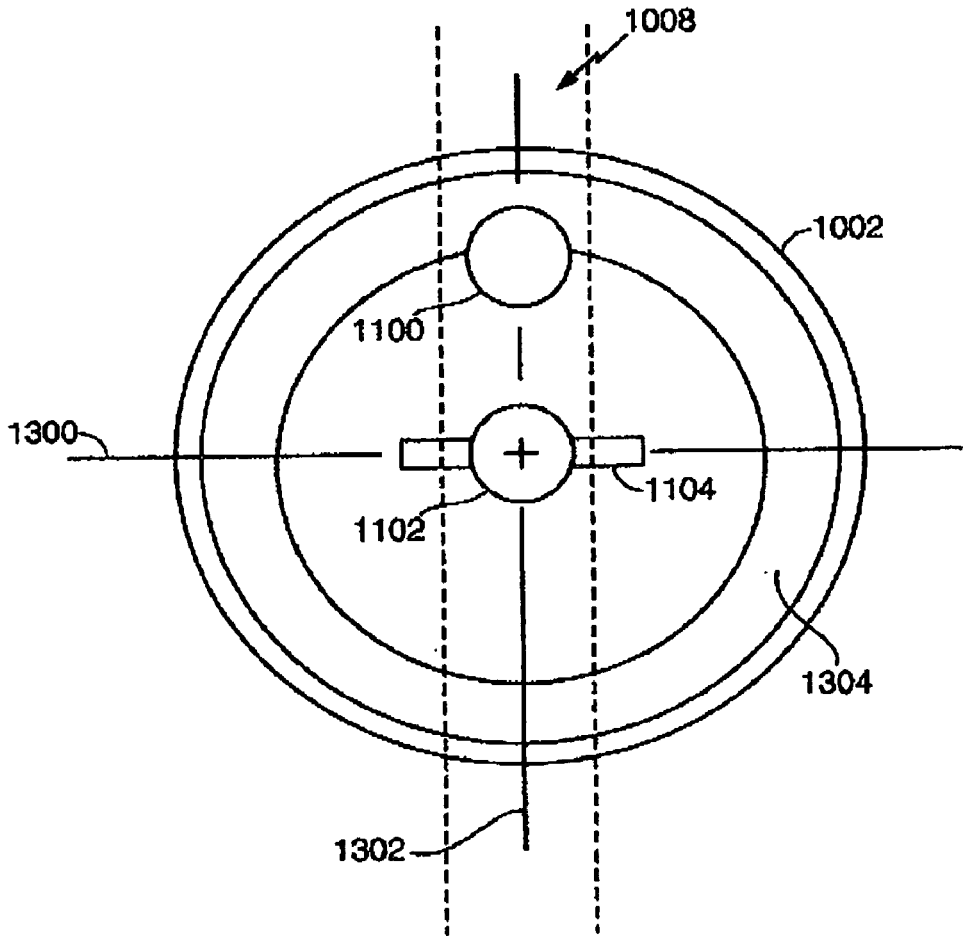
FIG. 13 is a bottom planar view of the fin guard of FIG. 10.

FIG. 13 illustrates a bottom planar view of fin guard 1000 of FIG. 10. In this illustration, tab 1104 extends from both sides of shaft 1102 along a longitudinal axis 1300. Deadbolt 1100 is located along an axis 1302 perpendicular to longitudinal axis 1300. The alignment between deadbolt 1100 and tab 1104 is such that both features extend into a channel (shown as dashed lines 1008) located on a bottom surface of a sports board installation, with tab 1104 locking within channel 1008 and deadbolt 1100 extending into channel 1008 preventing rotation of housing 1002 and, thus, tab 1104.

Installation of fin guard 1000 onto surfboard 106 is accomplished by, first, having deadbolt 1100 retracted, i.e., locking mechanism 1004 in an unlocked position. Housing 1002 is rotated such that tab 1104 is parallel to channel 1008. The housing is then placed flush against the bottom surface of surfboard 106, generally just behind fin 1006, allowing shaft 1102 and tab 1104 to extend into channel 1008. An optional race 1304 allows a fin mounting fastener, located on the bottom surface of surfboard 106, to be inserted into race 1304 at this point, thereby allowing housing 1002 to lie smoothly against the bottom surface of surfboard 106. Although shown as completely circumnavigating the circumference of housing 1002, race 1304 may, in other embodiments, comprise a hole or other depression that does not completely circumnavigate the circumference of housing 1002.

Figure 14A:
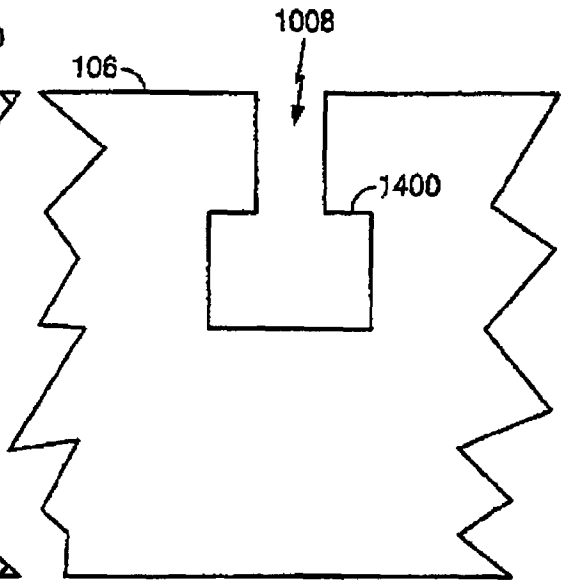
FIG. 14*a* is a cross-sectional view of a channel located underneath a bottom surface of a sports board.
Figure 14B:
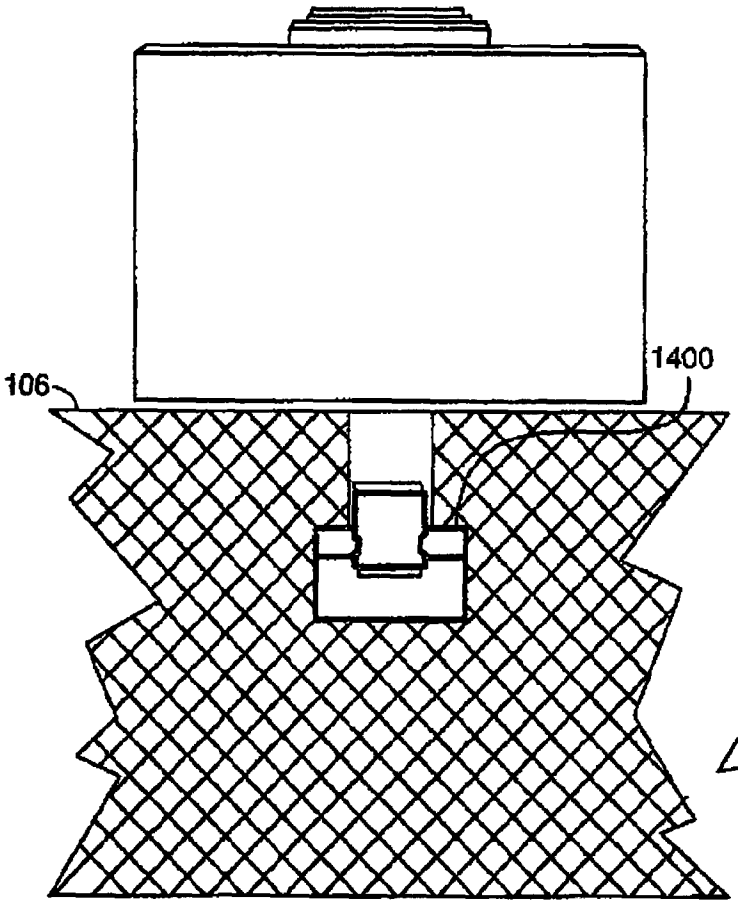
FIG. 14*b* is a cross sectional view of the channel of FIG. 14*a*, with the fin guard of FIG. 10 installed thereon.

With housing 1002 resting flush against the bottom surface of surfboard 106, housing 1002 is then rotated such that tab 1104 is perpendicular to channel 1008 and engaging a lip 1200 within channel 1008 (shown in cross section in FIG. 14*a*). In this position, deadbolt 1100 is also aligned with channel 1008. Next, deadbolt 1100 is inserted into channel 1008, and is locked in place by placing locking mechanism 1004 in a locked position. With deadbolt 1100 inserted into channel 1008, housing 1002, and therefore tab 1104, cannot rotate, thereby preventing removal of fin guard 1000 and, thus, fin 1006. The final installation is shown in cross section in FIG. 14*b*. Removal of fin guard 1000 involves unlocking locking mechanism 1004 such that deadbolt 1100 retracts from channel 1008 and into housing 1002. Housing 1002 is then rotated approximately 90 degrees, thus disengaging tab 1004 from lip 1400. Housing 1002 is then free to be removed from the surface of the surfboard.

Figure 15:
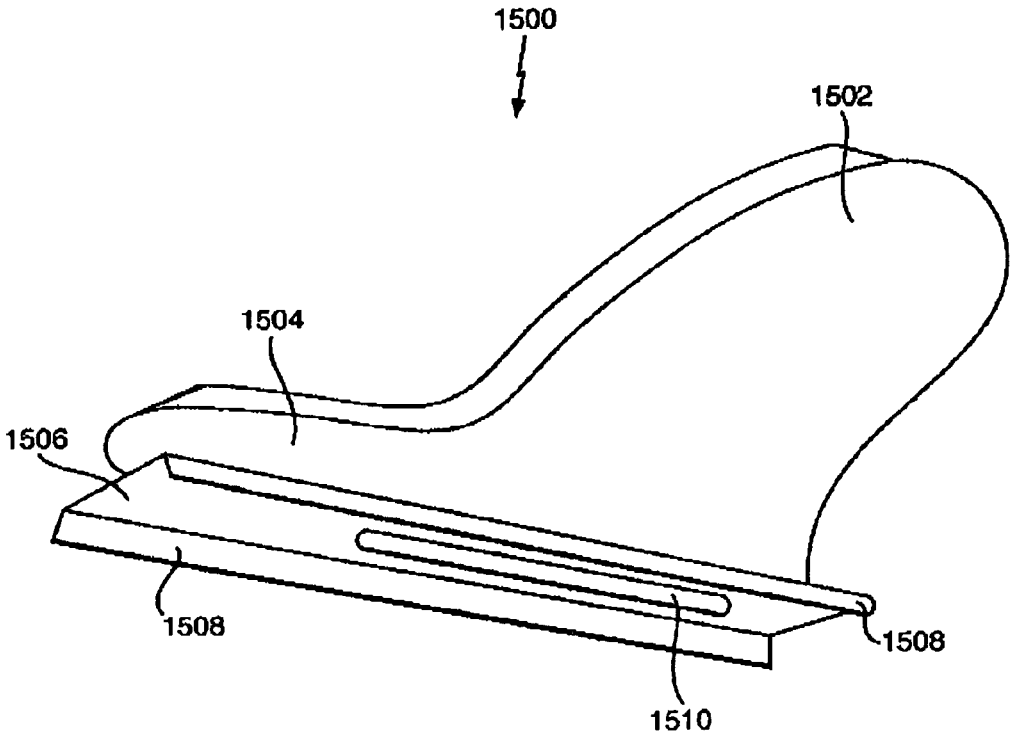
FIG. 15 illustrates another embodiment of a fin guard in use with a sports board, shown in an isometric view.

FIG. 15 is an isometric view of another embodiment of a fin guard, shown as fin guard 1500. Fin guard 1500 is designed to cover a sports board fin to prevent the fin from being removed from a sports board. Fin guard 1500 is especially useful on fins that are removable without using any type of fin locking fasteners. Such fins are removed generally by simply prying the fin out of a channel located beneath the bottom surface of the sports board.

Fin guard 1500 comprises a fin enclosure 1502 and an elongated member 1504, which is sized and shaped to wedge between an inner portion of the locking apparatus of FIG. 1 or FIG. 6 and the bottom surface of surfboard 106, thereby preventing fin guard 1500, and thus a surfboard fin, from being removed from surfboard 106. Fin enclosure 1502 is sized and shaped to accommodate various sizes of fins and is approximately one inch wide, in one embodiment. Fin enclosure 1502 is generally hollow, allowing fins to be completely enclosed by fin enclosure 1502.

Fin guard 1500 further comprises base 1506 to which elongated member 1504 and fin enclosure 1502 are mounted. Base 1506 may comprise raised edges 1508, which allows fin guard 1500 to rest flush against the bottom surface of surfboard 106, allowing for any fin mounting hardware to reside within a cavity formed by base 1506 and the bottom surface of surfboard 106. Base 1506 comprises a slotted opening 1510, allowing a fin to enter fin enclosure 1502.

Elongated member 1504, fin enclosure 1502, and base 1506 may be constructed of any rigid material such as plastic, metal, fiberglass, resins, etc. In one embodiment, elongated member 1504 and fin enclosure 1502 are constructed as a single unit, although that need not be the case. Further, elongated member 1504 and fin enclosure 1502 may be constructed by molding two half sections and joining the two halves together using glue, resin, epoxy, welding, or by other means known in the art. Base 1506 may likewise be manufactured from any suitable rigid material, and joined with elongated member 1504 and fin enclosure 1502 using the techniques just described.

Figure 16:
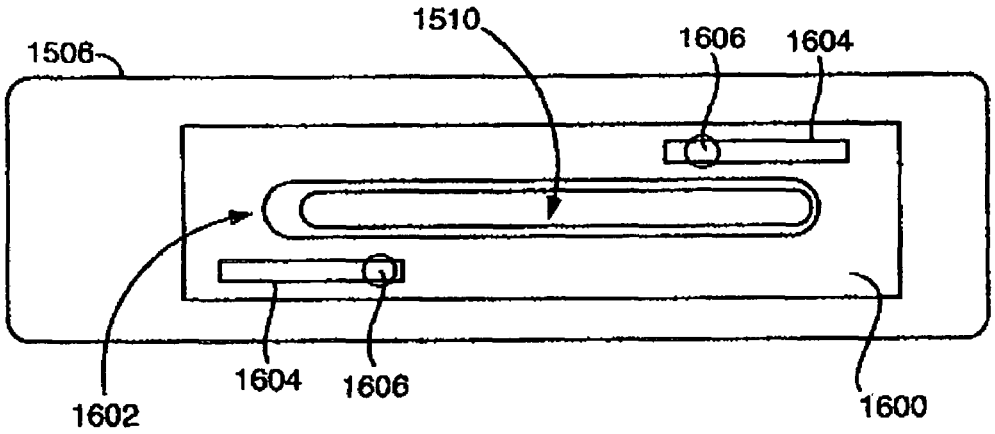
FIG. 16 illustrates a bottom view of the fin guard of FIG. 15.

FIG. 16 illustrates a bottom planar view of fin guard 1500. Shown is base 1506, and optional adjuster plate 1600. Adjuster plate 1600 is used to vary the length of slot opening 1510 to accommodate different sized fins. The thickness of adjuster plate 1600 is generally less than the height of raised edges 1508 so that adjuster plate 1600 fits within a cavity formed by base 1506 and the bottom surface of surfboard 106. Adjuster plate 1600 is mounted to base 1506 and comprises adjusting slot 1602, mounting slots 1604, and fasteners 1606. Adjusting slot 1602 is generally equal in length to slot opening 1510 and resides situated over slot opening 1510. The width of adjusting slot 1602 may be slightly larger than, equal to, or slightly smaller than slot opening 1510. The resultant slot, formed from the overlap of slot opening 1510 and adjusting slot 1602, can be varied in length depending on the location of adjusting slot 1602. This enables fins of various sizes to be accepted by fin enclosure 1502. The size of the resultant slot is varied by sliding adjuster plate 1600 fore and aft and is then secured in place using fasteners 1606, which may comprise screws, bolts, or other fastening means. It should be understood that adjuster plate 1600 could also be used to vary the position of adjusting slot 1602, rather than the size of a resultant slot, if slot opening 1510 is not used. In other words, if fin enclosure 1502/base 1506 does not comprise slotted opening 1510 and simply comprises open space leading into fin enclosure 1502, then adjuster plate 1600 can be used to position adjusting slot 1602 fore and aft, to accommodate various fin positions.

Figure 17:
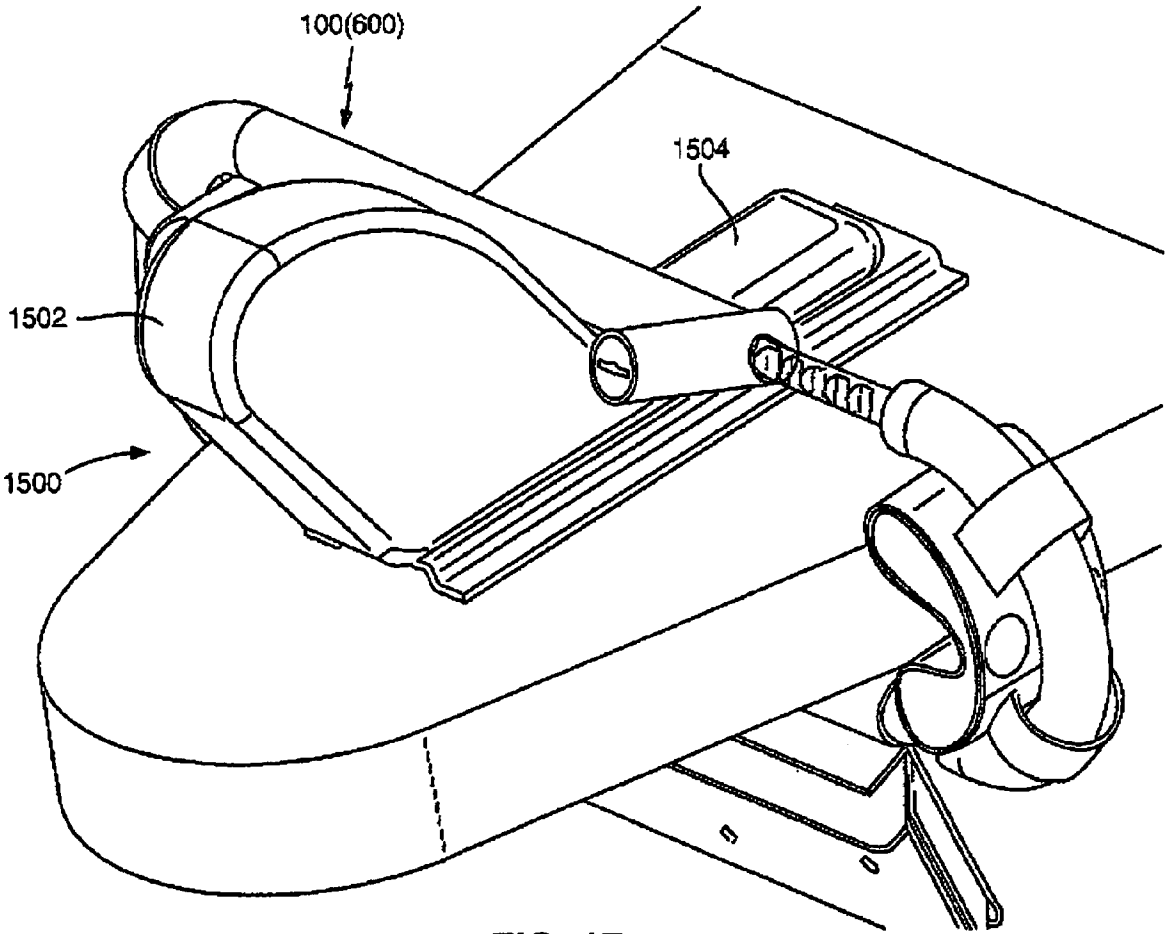
FIG. 17 illustrates the fin guard of FIG. 15 installed onto a sports board fin and used in conjunction with a sports board security apparatus of either FIG. 1 or FIG. 6.

FIG. 17 is an isometric view of fin guard 1500 installed over a surfboard fin and used in conjunction with the security apparatus 100 of FIG. 1 or 600 of FIG. 6. Fin enclosure 1502 is shown covering a fin of surfboard 106, while elongated member 1504 is shown wedged between a bottom surface of surfboard 106 (along with base 1506) and an inner surface of adjustable shackle 304 of the security apparatus of FIG. 1 or FIG. 6. It should be understood that elongated member 1504 may be directly in contact with the bottom surface of a sports board (in the case where base 1506 is absent, or if base 1506 only extends the length of fin enclosure 1502) or sandwiched between base 1506 and the security apparatus of FIG. 1 or FIG. 6, with base 1506 in contact with the bottom surface of surfboard 106. Fin guard 1500 cannot be removed from the fin, because of the wedging effect of elongated member 1504. Surfboard 106 cannot move in an aft direction because of the contour of surfboard 106 against the security apparatus of FIG. 1 or FIG. 6.

Figure 18A:
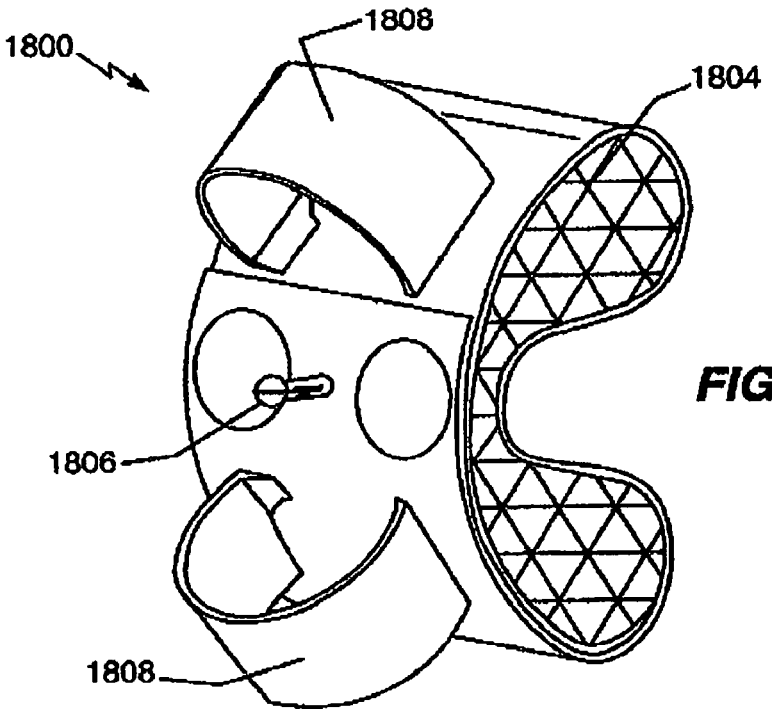
FIGS. 18*a* and 18*b* illustrate two views of an optional cushion used in the security apparatus of FIG. 1 or FIG. 6.
Figure 18B:
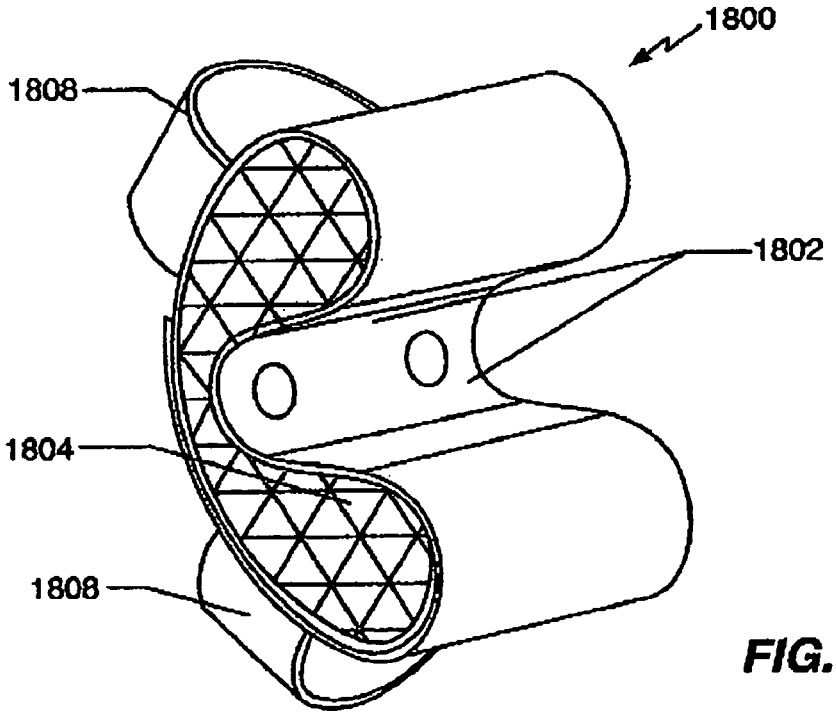

FIGS. 18*a* and 18*b* illustrate two views of an optional cushion 1800 used in the security apparatus of FIG. 1 or FIG. 6. Cushion 1800 is typically used in pairs, each cushion secured to a curved portion of adjustable shackle 304 or 804, as the case may be. Although not essential to the embodiments described herein, the optional cushions allow a surfboard 102 to be secured within an opening formed by adjustable shackle 304 or 804 without damaging the rails of surfboard 102. Additionally, the cushions 1800 allow a top and bottom surfaces of surfboard 102 to avoid contact with an inside surface of adjustable shackle 304 or 804, thereby avoiding damage to those surfaces.

Cushion 1800 comprises a contact surface 1802 which is designed to conform to a surfboard rail cross-section. Contact surface 1802 comprises a material which is semi-rigid, allowing the contact surface 1802 to flex and fit snugly against a surfboard rail. The material comprises a smooth surface so that the surfboard rails are not scratched or otherwise damaged by the cushion. Examples of such materials include plastic, rubber, polyurethane, or other suitable material. Cushion 1800 typically comprises filler 1804 for helping maintain the overall shape of the cushion. Filler 1804 may comprise varying degrees of elasticity, ranging from soft to hard. In one embodiment, filler 1804 comprises foam rubber, but in other embodiments, could comprise plastic, epoxy, resin, rubber, wood, etc. In yet another embodiment, no filler is used.

It should also be understood that cushion 1800 could alternatively comprise a malleable object, such as a balloon filled with gel, air, or some other material. In such an embodiment, cushion 1800 would conform to a surfboard rail cross-section upon impact with the surfboard.

Cushion 1800 typically comprises one or more means for securing the cushion to adjustable shackle 304 or 804. As illustrated in FIG. 18, fastening means 1806 comprises a pin which comprises a flared end that is inserted through a hole located on a curved portion inner surface of adjustable shackle 304 or 804. The length of the pin is such that it will not allow cushion 1800 to be rotated or displaced laterally, disengaging the pin from the hole in the curved portion, thereby providing additional clearance that could allow the surfboard to be removed. Cushion 1800 additionally comprises retainers 1208 for wrapping around a portion of adjustable shackle 304 or 804, thereby additionally securing cushion 1800 in place. The retainers 1808 may comprise any material for wrapping around a portion of adjustable shackle 304 or 804 including string, tie-wraps, leather straps, or, in the embodiment shown in FIG. 18, VELCRO® straps. The retainers 1808 are secured to a rear portion of cushion 1800 by any suitable means, such as a pin, rivet, or other means.

Figure 19A:
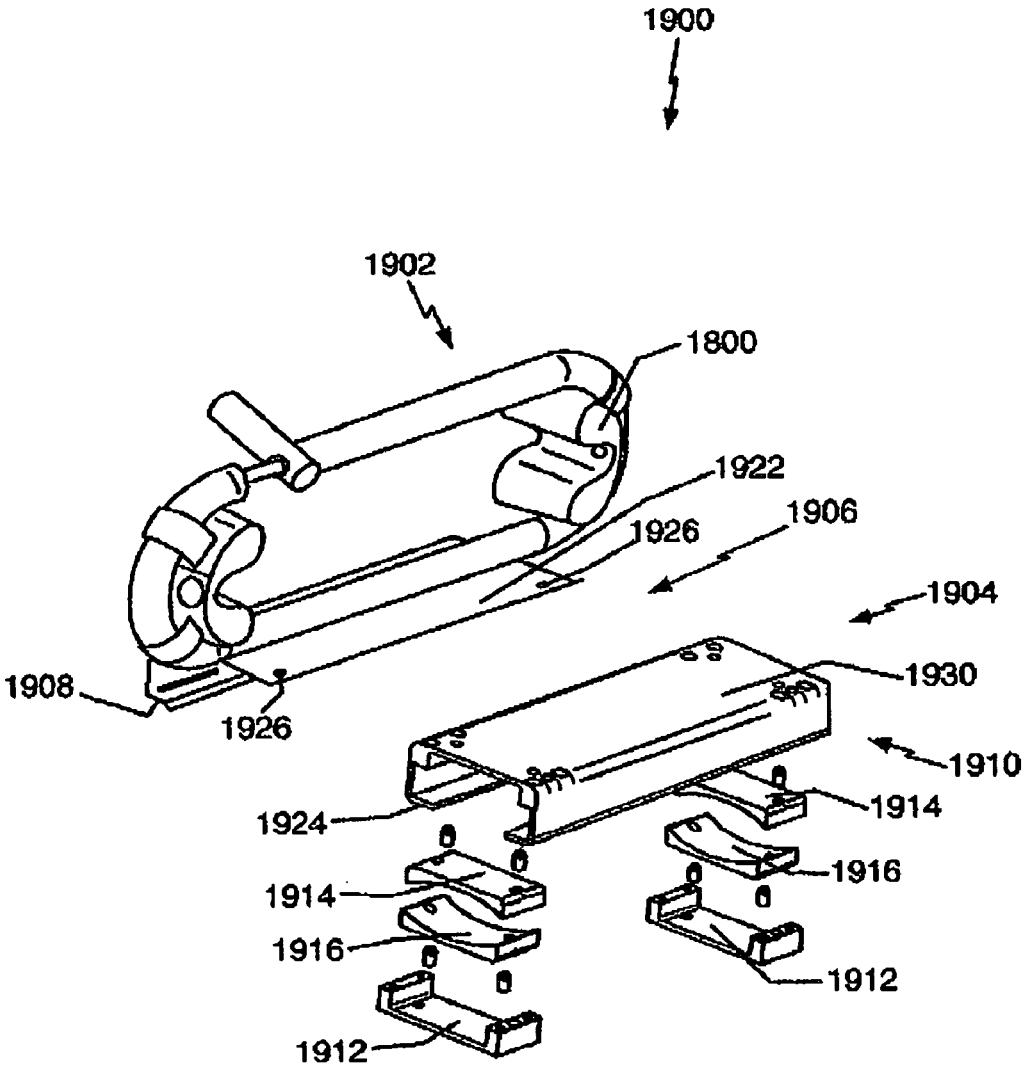
FIGS. 19*a* and 19*b* are exploded views of yet another embodiment of a security apparatus for securing a sports board to a vehicle.
Figure 19B:
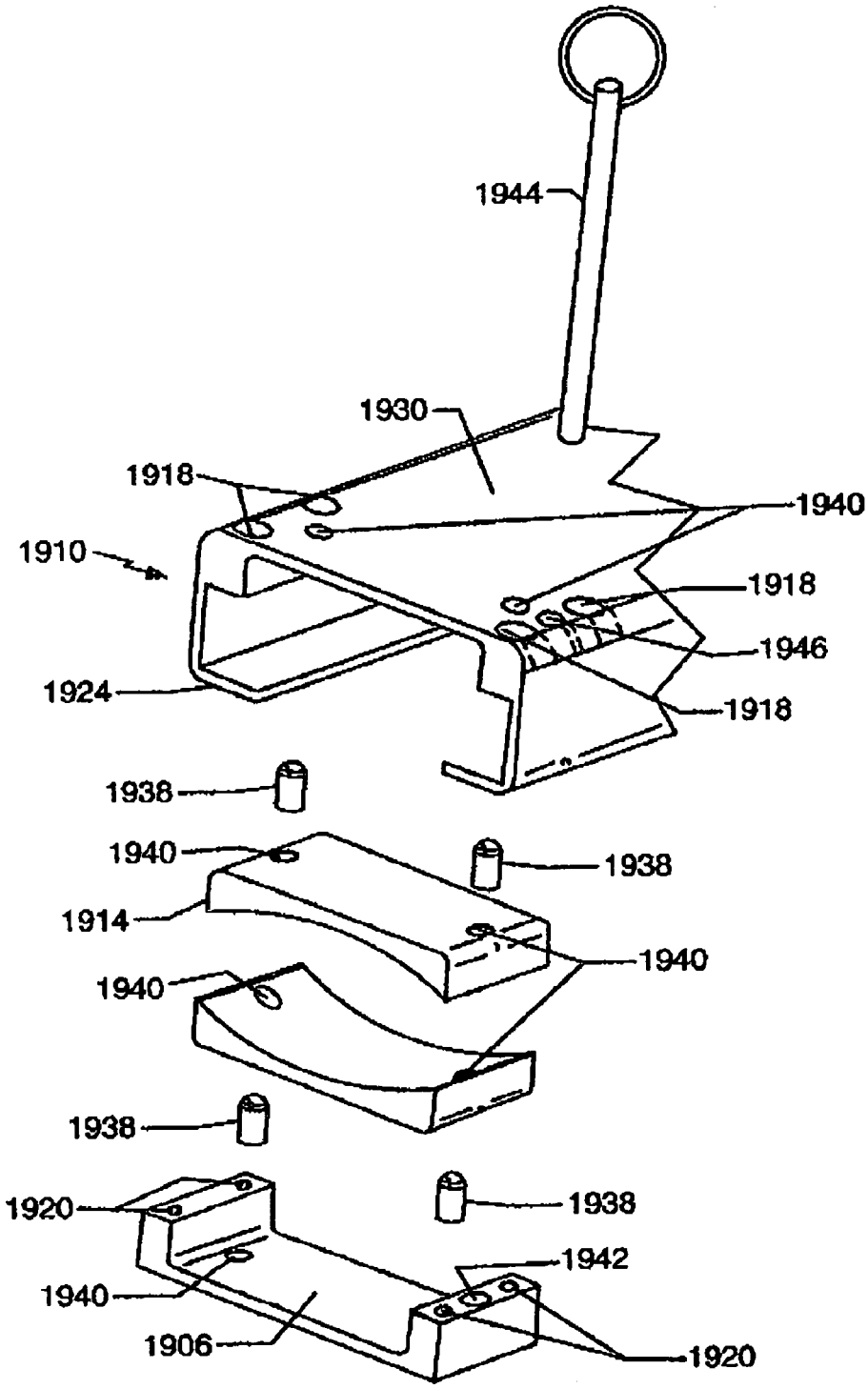

FIGS. 19*a* and 19*b* are exploded views of yet another embodiment of a security apparatus 1900 for securing an object to a vehicle. Cushions 1800 are installed as illustrated. The security apparatus of this embodiment comprises mating unit 1902 and mounting bracket 1904. The mating unit 1902 is quite similar to mating unit 300 of FIG. 3 with the exception of mating portion 1906. Mating portion 1906 comprises an L-shaped extrusion which slides over mounting bracket 1904 upon installation. Mating portion 1906 comprises a bottom lip 1908 which prevents mating unit 1902 from being removed from mounting bracket 1904 after mating unit 1902 is removably secured to mounting bracket 1904.

Mounting bracket 1904 comprises extrusion 1910, lower bracket 1912, upper insert 1914, and lower insert 1916. A vehicle roof rack is sandwiched between upper insert 1914 and lower insert 1916, then the inserts are secured within extrusion 1910 using lower bracket 1912.

FIG. 19*b* shows a more detailed view of extrusion 1910, lower bracket 1912, upper insert 1914, and lower insert 1916. Lower insert 1916 is held within lower bracket 1912 and upper insert 1914 held within extrusion 1910 by one or more fastening means 1938. Fastening means 1938 comprises four retaining pins which fit into receiving holes 1940 located on extrusion 1910, lower bracket 1912, upper insert 1914, and lower insert 1916, as shown. Of course, a greater or fewer number of fastening means could be used in the alternative, or other means could be used, either alternatively or in addition to, to fasten the inserts to extrusion 1910 and lower bracket 1912. When the components of FIG. 19*b* are assembled, the inserts form an opening which conforms to the shape of a vehicle roof rack. The inner surface of the inserts may be shaped to conform with the different roof rack shapes available on the market from vehicle manufacturers or after-market suppliers.

The lower bracket 1912 is fixedly secured to extrusion 1910 using any known fastening means, such as screws, rivets, bolts, etc. through holes 1918 and 1920. Four pairs of such holes are shown in the embodiment of FIG. 19*b* but a fewer or greater number of holes could be used in the alternative. The lower bracket 1912 may be secured to extrusion 1910 by other means, such as welding, either in addition or alternatively to the screws, rivets, or bolts. The mounting bracket 1904, therefore, is generally fixedly secured to a vehicle roof rack, and remains in place whether or not mating unit 1902 is attached. The inserts are held securely in place by the clamping force of the securing means.

Lower bracket 1912 comprises apertures 1942 which align with apertures 1946 on extrusion 1910 when assembly is complete. These apertures allow a retaining pin 1944 to be inserted therethrough. The apertures 1942 may comprise through holes or they may only extend a portion through lower bracket 1912.

During assembly of mating unit 1902 to mounting bracket 1904, the mating unit 1902 slides onto mounting bracket 1904, with an upper surface 1922 covering an upper surface 1930 of extrusion 1910. Bottom lip 1908 covers a portion of a lower surface 1924 of extrusion 1910. One or more apertures 1926 located on upper surface 1922 align with one or more apertures 1946 located on upper surface 1930 of extrusion 1910. A retaining pin 1944 similar to retaining pin 322 is then inserted through apertures 1926, 1946, and 1942, thereby removably securing mating unit 1902 to mounting bracket 1904. Like previous embodiments, the retaining pin is not removable when an object is secured through the adjustable shackle.

Figure 20:
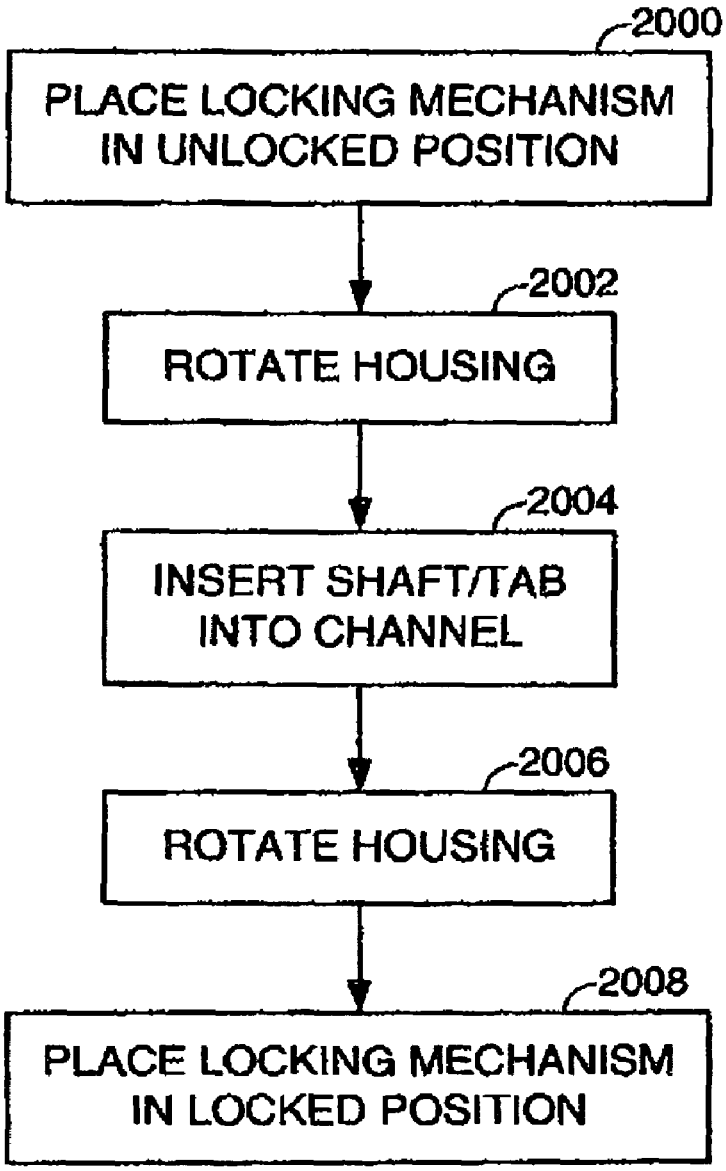
FIG. 20 illustrates a flow diagram illustrating a method for securing a sports board fin to a sports board using the fin guard of FIG. 10.

FIG. 20 is a flow diagram illustrating a method for securing a fin to a sports board using fin guard 1000. In step 2000, locking mechanism 1004 is placed in an unlocked position, thereby retracting deadbolt 1100 into housing 1002. In step 2002, housing 1004 is rotated such that tab 1104 is parallel to a channel located underneath a bottom surface of a sports board. The channel is used to secure a fin of the sports board in place, generally using a fastening means of some sort.

In step 2004, shaft 1102/tab 1004 is/are inserted into the channel until a bottom surface of housing 1002 is in contact with the bottom surface of the sports board. At this point, tab 1004 extends below a lip 1400 of the channel.

In step 2006, housing 1002 is rotated approximately 90 degrees, positioning tab 1004 perpendicular to the channel. Tab 1004 is now lodged beneath lip 1400, thereby preventing housing 1002 from being removed from the bottom surface of the surfboard.

In step 2008, locking mechanism 1004 is placed in a locked position, thereby causing deadbolt 1100 to extend from housing 1002 into the channel. Once deadbolt 1100 has been inserted into the channel, housing 1002 cannot be rotated, thereby preventing tab 1004 from being disengaged from lip 1400. The fin cannot be removed because housing 1002 covers the fin fastening means.

Figure 21:
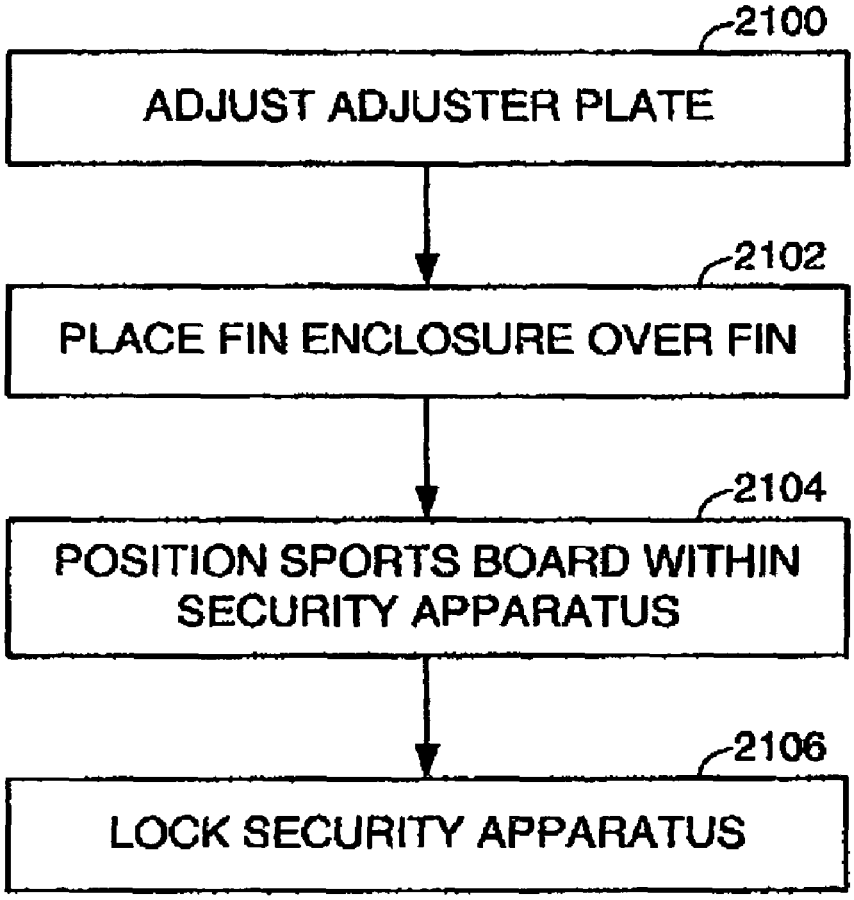
FIG. 21 is a flow diagram illustrating a method for securing a sports fin to a sports board using the fin guard of FIG. 15.

FIG. 21 is a flow diagram illustrating a method for securing a fin to a sports board using fin guard 1500. In step 2100, an adjuster plate 1600 is moved to accommodate a certain fin size that is to be encapsulated by fin guard 1500. The adjuster plate is secured using fastening means 1606. Next, in step 2102, fin guard 1500 is placed over a fin of a sports board, the fin being enclosed by fin enclosure 1502. The base 1506 rests against a bottom surface of the sports board.

In step 2104, the sports board is positioned within, for example, security apparatus 100 of FIG. 1. The board is placed within adjustable shackle 304, with elongated member 1504 wedging between security apparatus 100 and the bottom surface of the sports board (and/or base 1506). In step 2106, adjustable shackle 304 is tightened around the sports board and locked in place. Fin guard 1500 is prevented from being removed from the sports board because of the physical relationship between security apparatus 100 and base 1506 in contact with the bottom of the sports board.

The previous description of the preferred embodiments is provided to enable any person skilled in the art to make and use the present invention. The various modifications to these embodiments will be readily apparent to those skilled in the art, and the generic principles defined herein may be applied to other embodiments without the use of the inventive faculty. Thus, the present invention is not intended to be limited to the embodiments discussed herein, but is to be accorded the widest scope consistent with the principles and novel features disclosed herein.

I claim:

1. An apparatus for securing a fin to a sports board, comprising:

a housing that covers a fin mounting fastener;

a first shaft having a first end connected to the housing and a second end extending away from the housing;

a tab located at the second end of the first shaft that engages a lip of a sports board channel when said apparatus is in a locked position and that disengages the lip when said apparatus is in an unlocked position;

a second rigid shaft spaced a fixed distance from the first shaft, the second rigid shaft having a first end connected to the housing and a second end extending away from the housing; and a locking mechanism that prevents removal of the housing from the sports board when the locking mechanism is in a locked position and that allows removal of the housing from the sports board when the locking mechanism is in an unlocked position.

2. The apparatus of claim 1, wherein the second rigid shaft comprises a retractable deadbolt that extends into the channel when the apparatus is in a locked position, and retracts into the housing when the apparatus is in an unlocked position.

3. The apparatus of claim 2, wherein the locking mechanism is used to extend and retract the second rigid shaft.

4. The apparatus of claim 1, wherein the second rigid shaft extends from a bottom surface of the housing when the apparatus is in either the locked or unlocked position and the first shaft is rotatable about an axis perpendicular to the bottom surface of the housing.

5. The apparatus of claim 4, wherein the locking mechanism is used to rotate the first shaft about the axis.

6. The apparatus of claim 1, further comprising a depression located on a bottom surface of the housing, that receives said fin mounting fastener.

7. Apparatus for securing a sports board fin to a sports board, comprising:

means for covering that covers a fin mounting fastener;

means for locking said means for covering to a bottom surface of the sports board, the means for locking comprising;

a first shaft having a first end connected to the means for covering and a second end extending away from the means for covering;

a tab located at the second end of the first shaft that engages a lip of a sports board channel when said apparatus is in a locked position and that disengages the lip when said apparatus is in an unlocked position;

a second rigid shaft spaced a fixed distance from the first shaft, the second rigid shaft having a first end connected to the means for covering and a second end extending away from the means for covering; and a locking mechanism that prevents removal of the means for covering from the sports board when the apparatus is in a locked position and that allows removal of the means for covering from the sports board when the apparatus is in an unlocked position.

8. The apparatus of claim 7, wherein the first shaft extends from a bottom surface of the means for covering when the apparatus is in either the locked or unlocked position and the second rigid shaft comprises a retractable deadbolt that extends into the channel when the apparatus is in a locked position, and retracts into the means for covering when the apparatus is in an unlocked position.

9. The apparatus of claim 8, wherein the locking mechanism is used to extend and retract the second rigid shaft.

10. The apparatus of claim 7, wherein the second rigid shaft extends from a bottom surface of the means for covering when the apparatus is in either the locked or unlocked position and the first shall is rotatable about an axis perpendicular to the bottom surface of the means for covering.

11. The apparatus of claim 10, wherein the locking mechanism is used to rotate the first shaft about the axis.

* * * * *